US007874444B2

(12) United States Patent
Ashworth

(10) Patent No.: US 7,874,444 B2
(45) Date of Patent: Jan. 25, 2011

(54) THERMOSTATIC CONTROLLER WITH DECORATIVE FACEPLATE

(75) Inventor: Nicholas Ashworth, Dublin, OH (US)

(73) Assignee: Ranco Incorporated of Delaware, Carol Stream, IL (US)

( * ) Notice: Subject to any disclaimer, the term of this patent is extended or adjusted under 35 U.S.C. 154(b) by 1462 days.

(21) Appl. No.: 10/974,353

(22) Filed: Oct. 27, 2004

(65) Prior Publication Data

US 2006/0086062 A1 Apr. 27, 2006

(51) Int. Cl.
*H02G 3/08* (2006.01)
*H02G 3/14* (2006.01)
*H05K 5/03* (2006.01)

(52) U.S. Cl. ..... 220/3.2; 174/66

(58) Field of Classification Search ..... 220/3.2, 220/4.02, 241, 242; 174/66, 67; 439/536
See application file for complete search history.

(56) References Cited

U.S. PATENT DOCUMENTS 2,273,375 A * 2/1942 Ray ..... 337/79
3,930,611 A 1/1976 Demaray
4,282,591 A 8/1981 Andreuccetti
4,288,990 A 9/1981 Schulz
4,462,540 A 7/1984 Dytch
4,824,013 A 4/1989 Gouldey
4,969,508 A 11/1990 Tate et al.
5,082,173 A 1/1992 Poehlman et al.
5,271,558 A 12/1993 Hampton
5,272,477 A 12/1993 Tashima et al.
5,595,342 A 1/1997 McNair et al.
5,675,125 A * 10/1997 Hollinger ..... 174/66
5,803,357 A 9/1998 Lakin
5,833,134 A 11/1998 Ho et al.
5,834,695 A * 11/1998 Herbert ..... 174/66
5,837,937 A * 11/1998 Reese et al. ..... 174/66
5,924,486 A 7/1999 Ehlers et al.
6,116,512 A 9/2000 Dushane et al.
6,213,404 B1 4/2001 Dushane et al.
6,444,909 B1 * 9/2002 Prenderville ..... 174/66

(Continued)

OTHER PUBLICATIONS

Easy Heat Programmable Thermostat; Models FTS-1 (120VAC) & FTS-2 (208/240VAC); Operating & Installation Instructions; M14057-001 Rev. I; © 2002 Easy Heat; www.easyheat.com.

(Continued)

*Primary Examiner*—Anthony Stashick
*Assistant Examiner*—Harry A Grosso
(74) *Attorney, Agent, or Firm*—Reinhart Boerner Van Deuren P.C.

(57) ABSTRACT

A thermostatic controller apparatus includes a housing having a front face thereof defining a decorative surface of the housing and adapted for optional attachment of a decorative faceplate covering the decorative surface of the housing. A plurality of decorative faceplates are provided, each having a distinctive visual appearance and adapted for optional attachment to the housing in such a manner that at least one selected faceplate of the plurality of decorative faceplates substantially covers the decorative surface of the housing when the selected decorative faceplate is attached to the housing. The selected decorative faceplate may have a visual appearance that differs from the visual appearance of the decorative surface of the housing, and may also include an aperture that is aligned with an aperture in the housing when the selected decorative faceplate is attached to the housing.

29 Claims, 26 Drawing Sheets

U.S. PATENT DOCUMENTS

| | | | |
|---|---|---|---|
| 6,449,533 | B1 | 9/2002 | Mueller et al. |
| 6,513,723 | B1 | 2/2003 | Mueller et al. |
| 2001/0048030 | A1 | 12/2001 | Sharood et al. |
| 2004/0133314 | A1 | 7/2004 | Ehlers et al. |
| 2005/0043907 | A1 | 2/2005 | Eckel et al. |
| 2005/0083168 | A1 | 4/2005 | Breitenbach |
| 2005/0194457 | A1 | 9/2005 | Dolan |

OTHER PUBLICATIONS

Theta Engineering, "Smart" Thermostat, website, date last visited Oct. 26, 2006, previously visited Oct. 27, 2005, 3 pages, http://www.thetaeng.com/SmartThermostat.htm.

* cited by examiner

FIG. 7
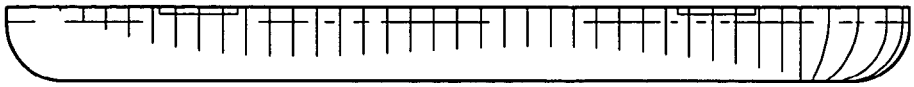
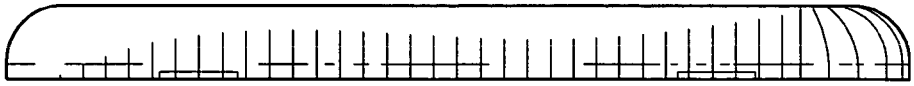
FIG. 8
FIG. 9
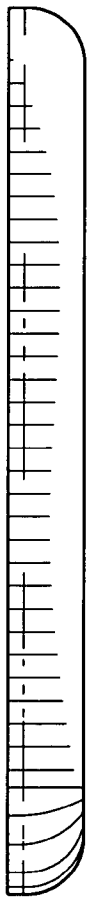
FIG. 10
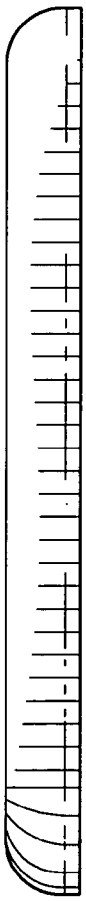

FIG. 14
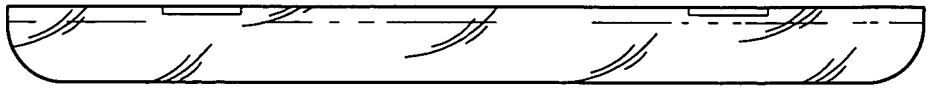
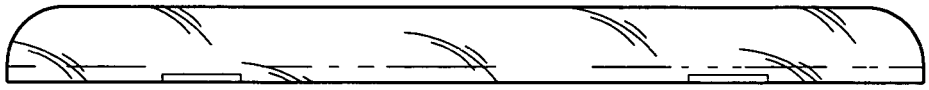
FIG. 15
FIG. 16
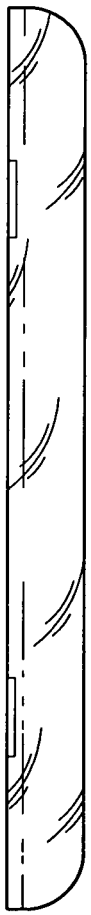
FIG. 17
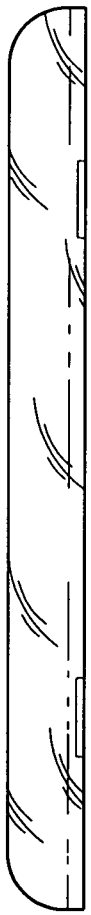

FIG. 21
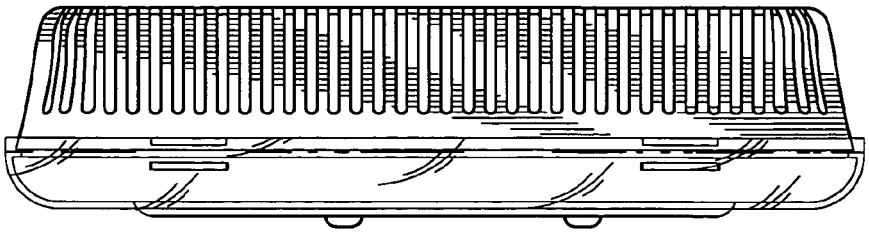
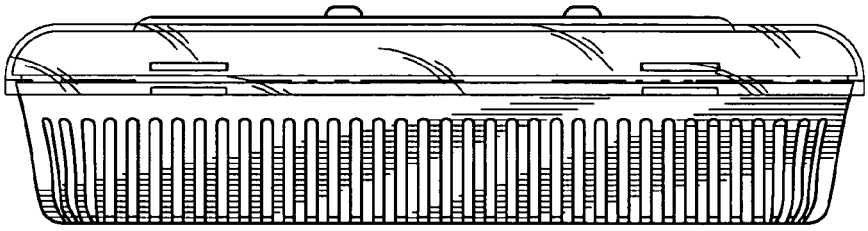
FIG. 22
FIG. 23
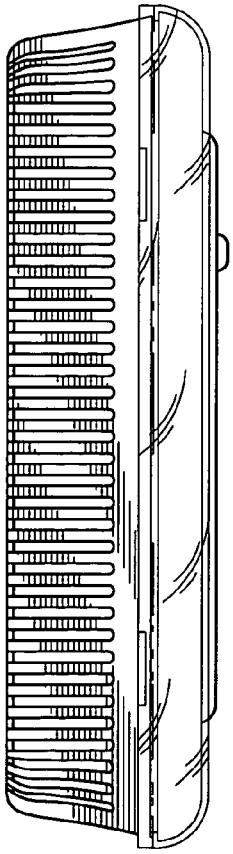
FIG. 24
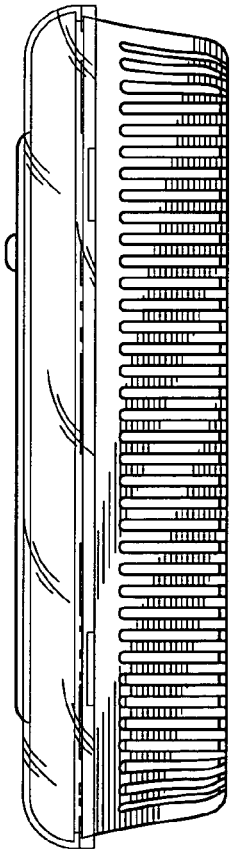

FIG. 28
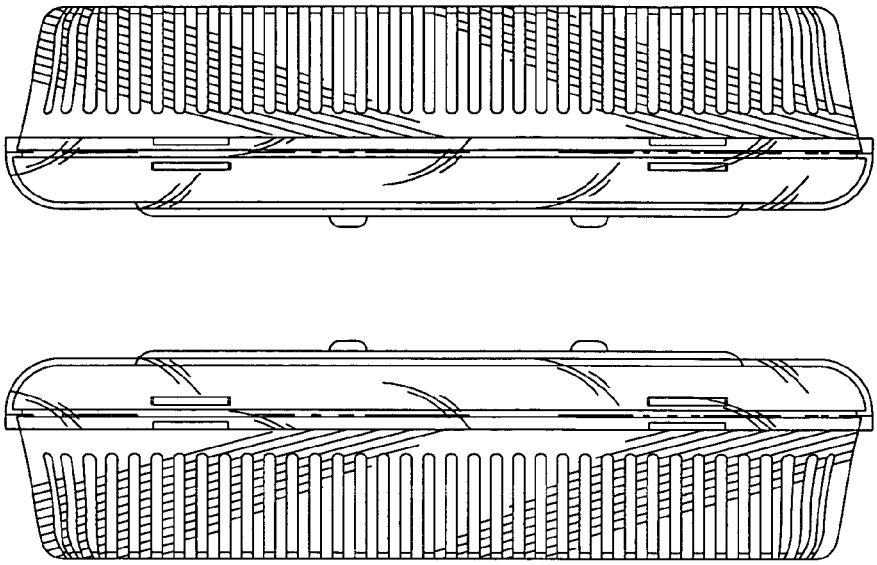
FIG. 29
FIG. 30
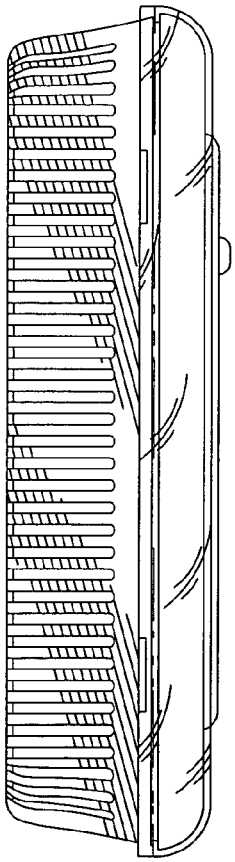
FIG. 31
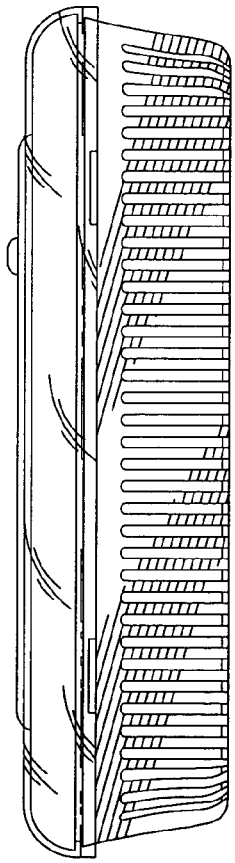

FIG. 35
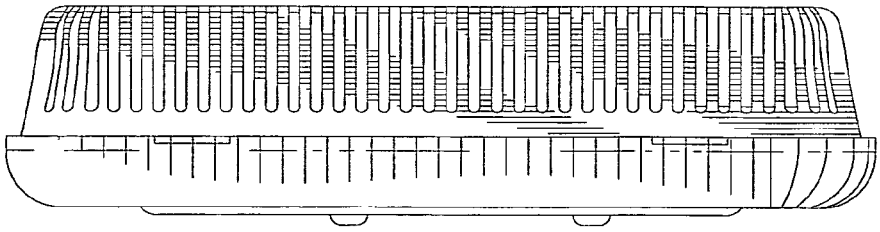
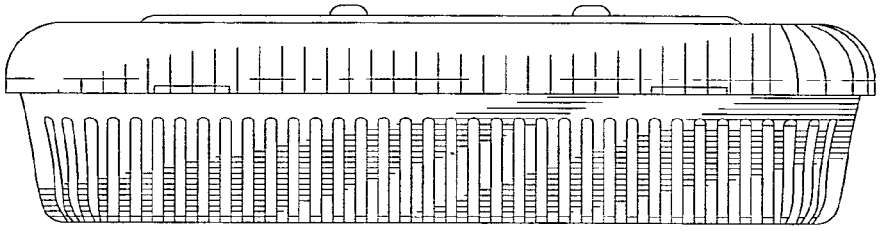
FIG. 36
FIG. 37
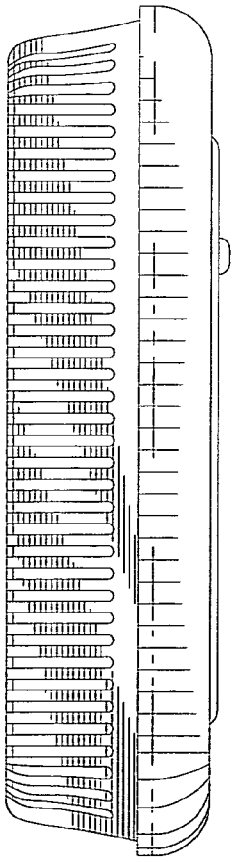
FIG. 38
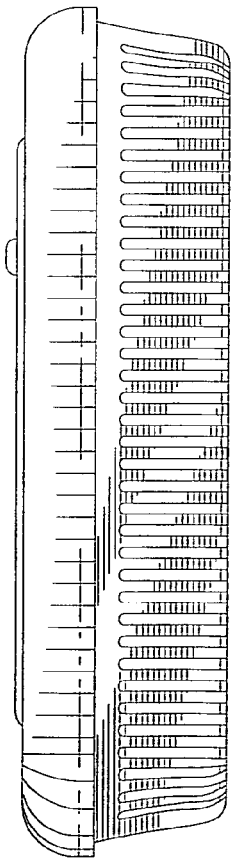

FIG. 42
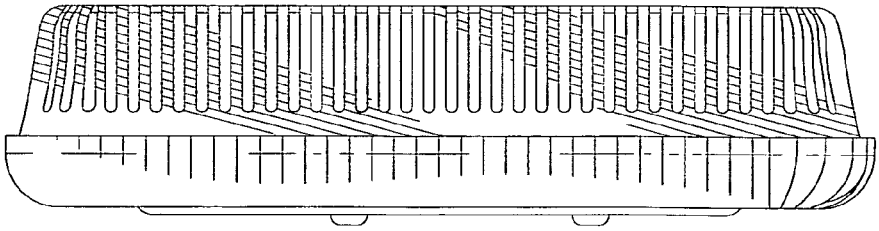
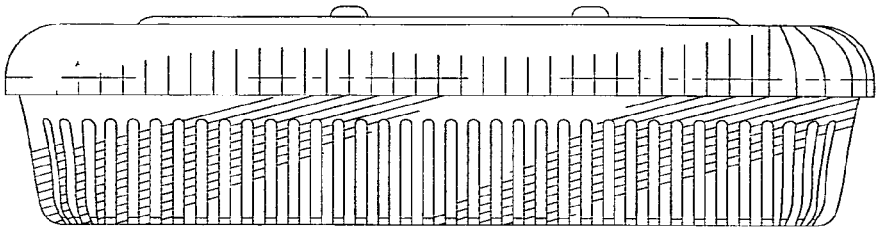
FIG. 43
FIG. 44
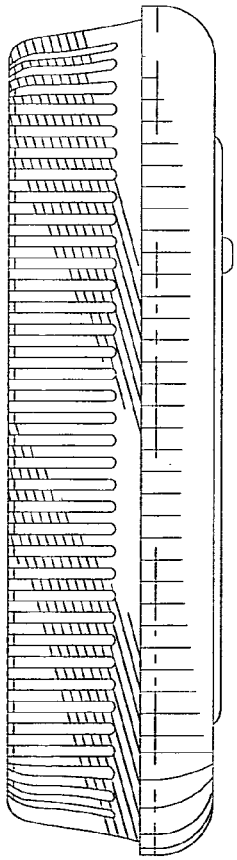
FIG. 45
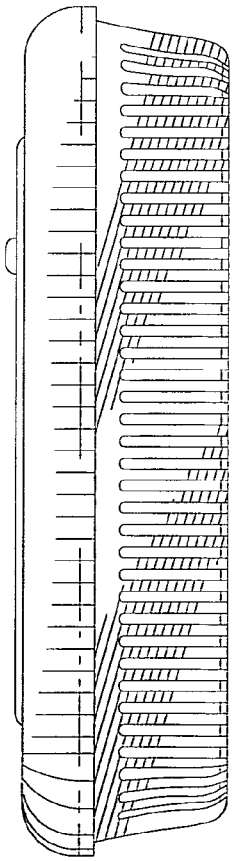

FIG. 49
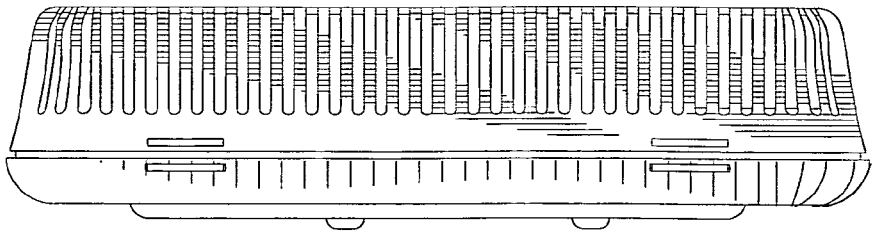
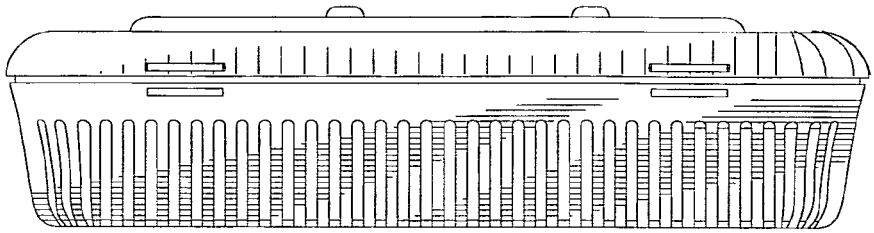
FIG. 50
FIG. 51
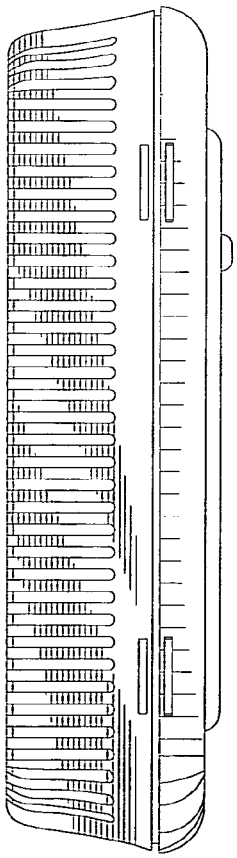
FIG. 52
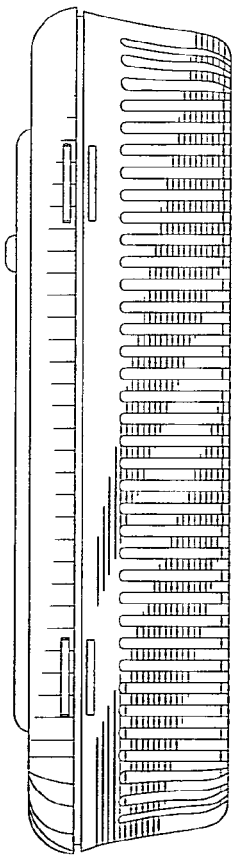

FIG. 56
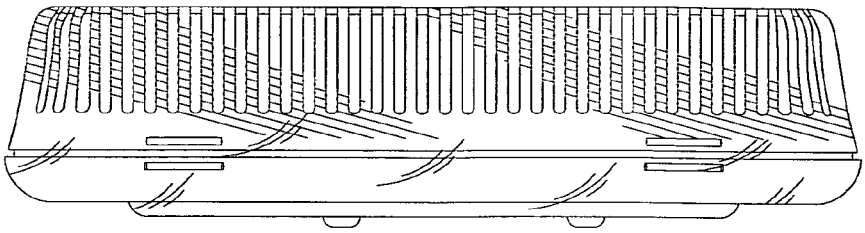
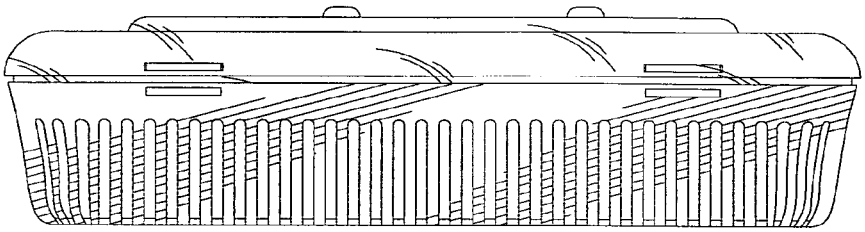
FIG. 57
FIG. 58
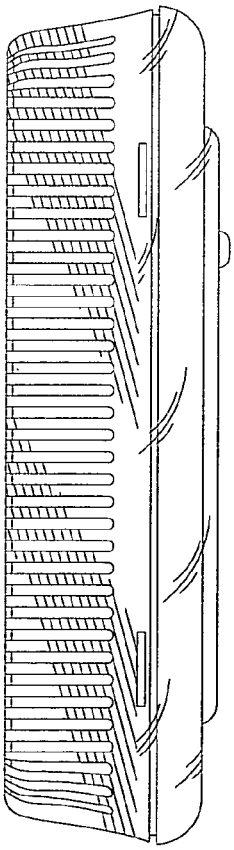
FIG. 59
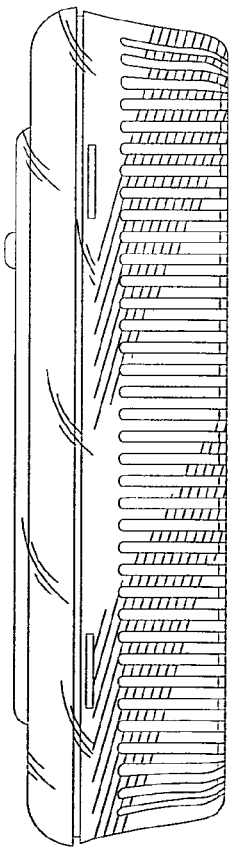

THERMOSTATIC CONTROLLER WITH DECORATIVE FACEPLATE

FIELD OF THE INVENTION

This invention relates to heating, ventilation and air conditioning (HVAC) systems, and more particularly to a thermostatic control unit, such as a wall mounted thermostat, of the type used in HVAC systems.

BACKGROUND OF THE INVENTION

Most HVAC systems used for providing temperature control of architectural spaces include a thermostatic controller, such as a thermostat, that is mounted on the wall of the space, for controlling the temperature of the space. Such thermostatic controllers typically include a number of internal working components enclosed in a housing. The housing may include a visual display and input elements, such as a knob, push buttons or a keypad, that are mounted in one or more apertures extending through a front face of the housing.

In the past, the housings of thermostatic controllers were primarily utilitarian in function and appearance, with any decorative aspects of the housing being of much lesser importance. As such, prior controllers were often somewhat unsightly, albeit necessary, features of the architectural design of an inhabited space.

It is desirable, therefore, to have an improved thermostatic controller apparatus and method for optionally conveniently changing the visual appearance of the controller housing in a manner that is aesthetically pleasing and more in harmony with a desired architectural theme for the space.

BRIEF SUMMARY OF THE INVENTION

The invention provides an apparatus and method for optionally and conveniently changing the visual appearance of a housing of a thermostatic controller, through the use of a housing having a front face thereof defining a decorative surface of the housing and adapted for optional attachment of a decorative faceplate covering the decorative surface of the housing. The housing may be used with the decorative surface of the housing exposed. Alternatively, a decorative faceplate may be attached to the housing in such a manner that the decorative faceplate substantially covers the decorative surface of the housing.

A plurality of decorative faceplates may be provided, with each of the faceplates having a distinctive visual appearance and being adapted for optional attachment to the housing in such a manner that at least one selected faceplate of the plurality of decorative faceplates substantially covers the decorative surface of the housing when the selected decorative faceplate is attached to the housing. The selected decorative faceplate may have a visual appearance that differs from the visual appearance of the decorative surface of the housing, and may also include an aperture that is aligned with an aperture in the housing when the selected decorative faceplate is attached to the housing.

The invention may also take the form of a method for changing the visual appearance of a thermostatic controller through use of an apparatus of the type disclosed herein.

Other aspects, objectives and advantages of the invention will be apparent from the following detailed description and the accompanying drawings. While the invention will be described in connection with certain preferred embodiments, there is no intent to limit it to those embodiments. On the contrary, the intent is to cover all alternatives, modifications and equivalents as included within the spirit and scope of the invention as defined by the appended claims.

BRIEF DESCRIPTION OF THE DRAWINGS

FIGS. 7 and 8 respectively are top and bottom plan views of FIG. 5.

FIGS. 9 and 10 respectively are left and right elevation views of FIG. 5.

FIGS. 14 and 15 respectively are top and bottom plan views of FIG. 12.

FIGS. 16 and 17 respectively are left and right elevation views of FIG. 12.

FIGS. 21 and 22 respectively are top and bottom plan views of FIG. 19.

FIGS. 23 and 24 respectively are left and right elevation views of FIG. 19.

FIGS. 28 and 29 respectively are top and bottom plan views of FIG. 26.

FIGS. 30 and 31 respectively are left and right elevation views of FIG. 26.

FIGS. 35 and 36 respectively are top and bottom plan views of FIG. 33.

FIGS. 37 and 38 respectively are left and right elevation views of FIG. 33.

FIGS. 42 and 43 respectively are top and bottom plan views of FIG. 40.

FIGS. 44 and 45 respectively are left and right elevation views of FIG. 40.

FIGS. 49 and 50 respectively are top and bottom plan views of FIG. 47.

FIGS. 51 and 52 respectively are left and right elevation views of FIG. 47.

FIGS. 56 and 57 respectively are top and bottom plan views of FIG. 54.

FIGS. 58 and 59 respectively are left and right elevation views of FIG. 54.

DETAILED DESCRIPTION OF THE INVENTION

Figure 1:
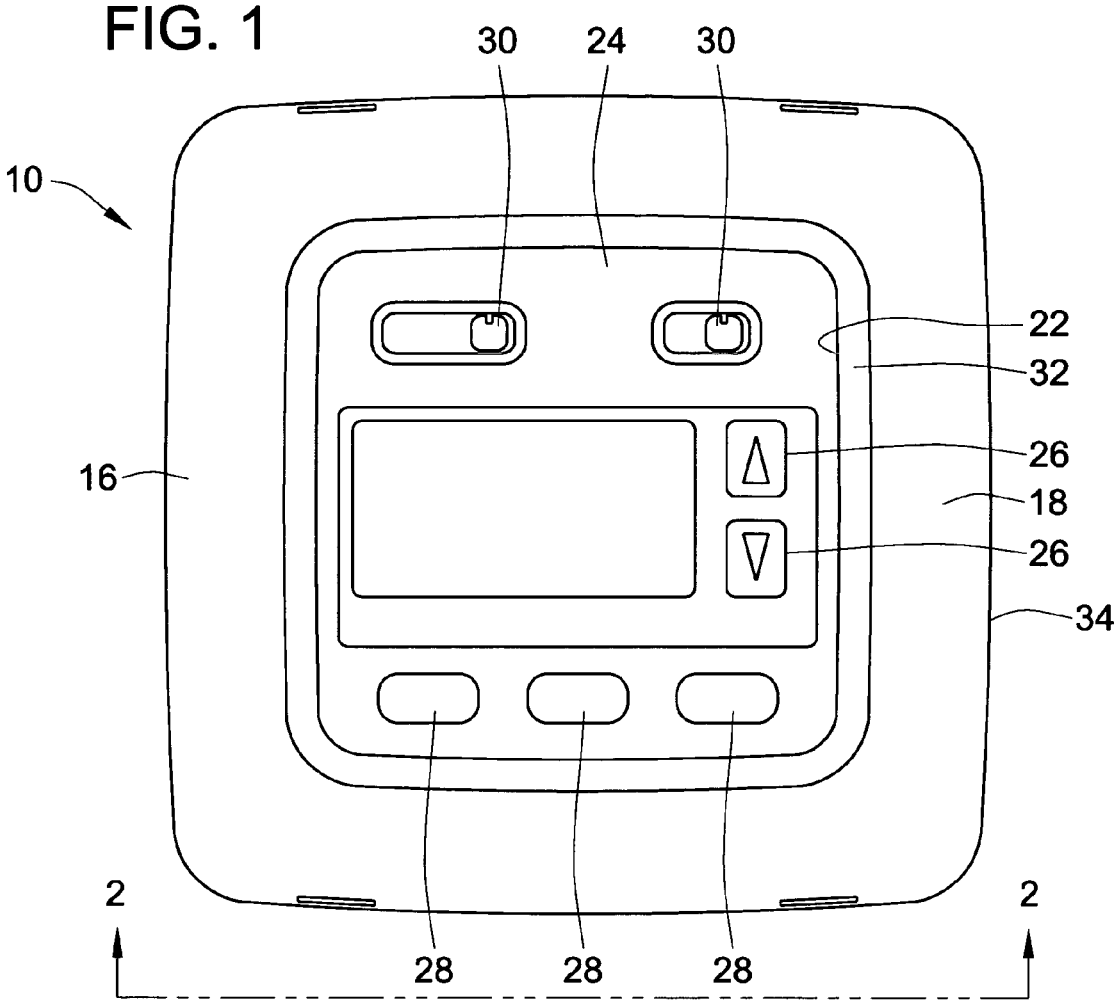
FIG. 1 is a front view of an exemplary embodiment of a thermostatic controller apparatus, according to the invention, in the form of a wall-mounted thermostat.
Figure 2:
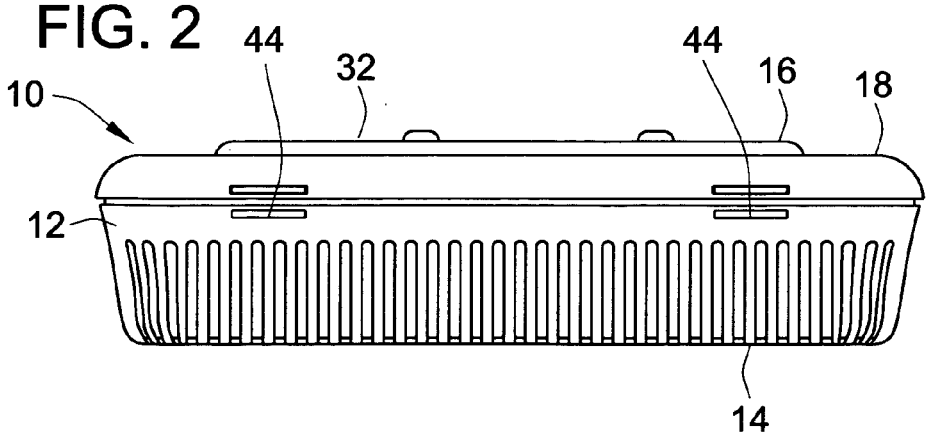
FIG. 2 is a bottom edge view of the thermostat of FIG. 1.
Figure 3:
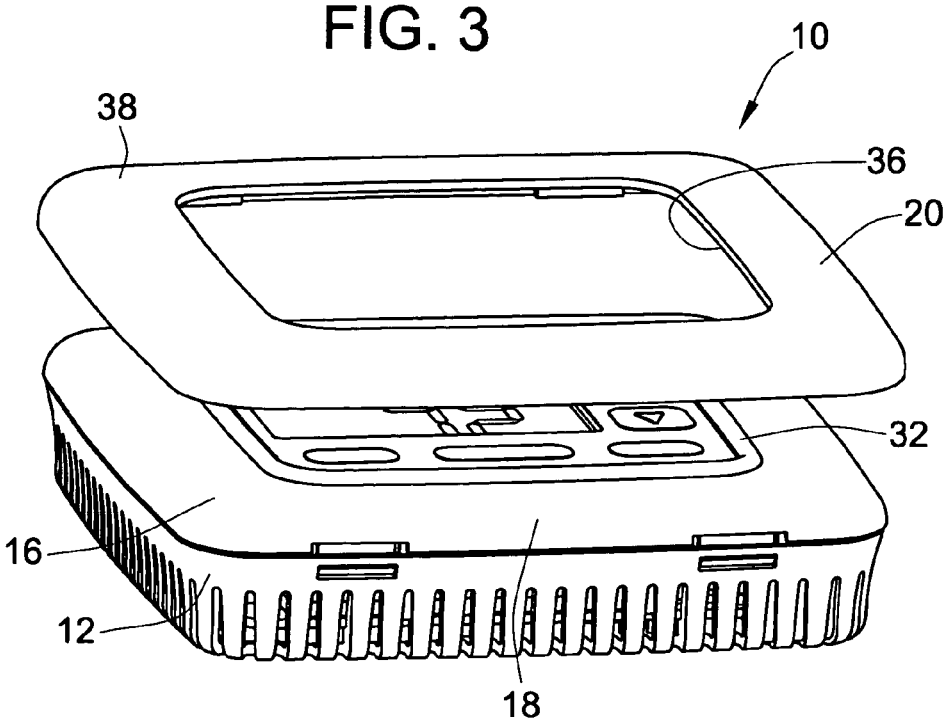
FIG. 3 is a perspective view of the exemplary embodiment of the thermostatic controller apparatus of FIG. 1, showing a decorative surface on the front face of the controller apparatus of FIG. 1, and the outer surface of a decorative face plate that is adapted for attachment to the housing of the controller of FIG. 1.
Figure 4:
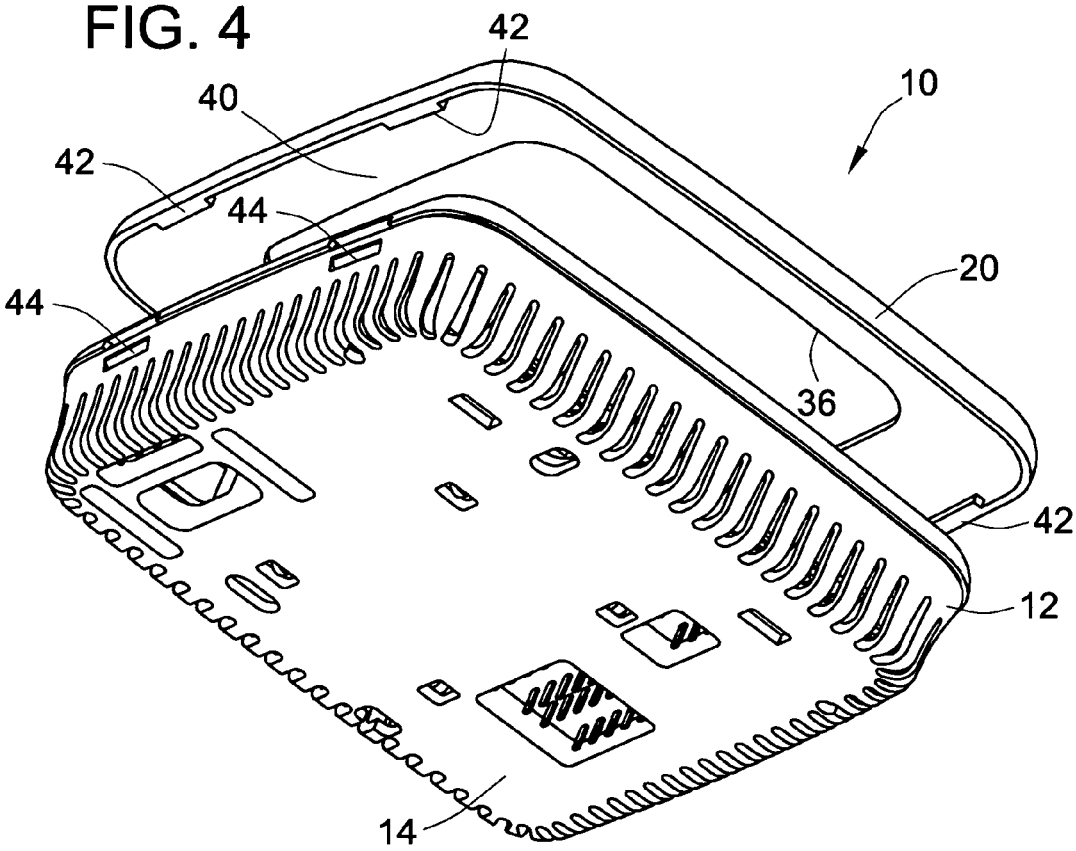
FIG. 4 is a perspective view of the thermostatic controller apparatus of FIG. 1, showing the rear surface of a housing of the controller, and the rear surface of the decorative face plate 20 also illustrated in FIG. 3.
Figure 5:
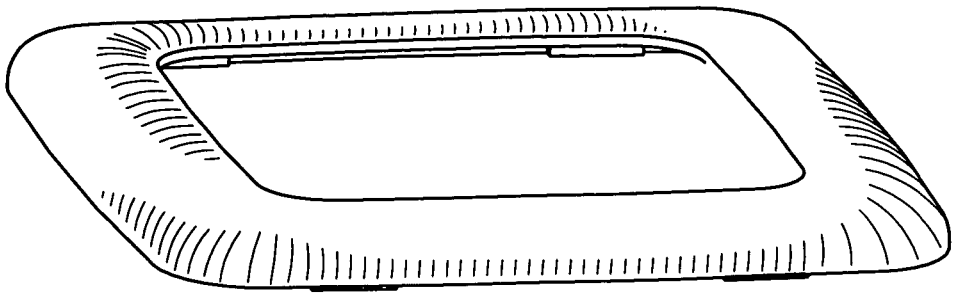
FIG. 5 is a perspective view of a decorative face plate of opaque material, according to the invention, for a thermostatic controller.
Figure 6:
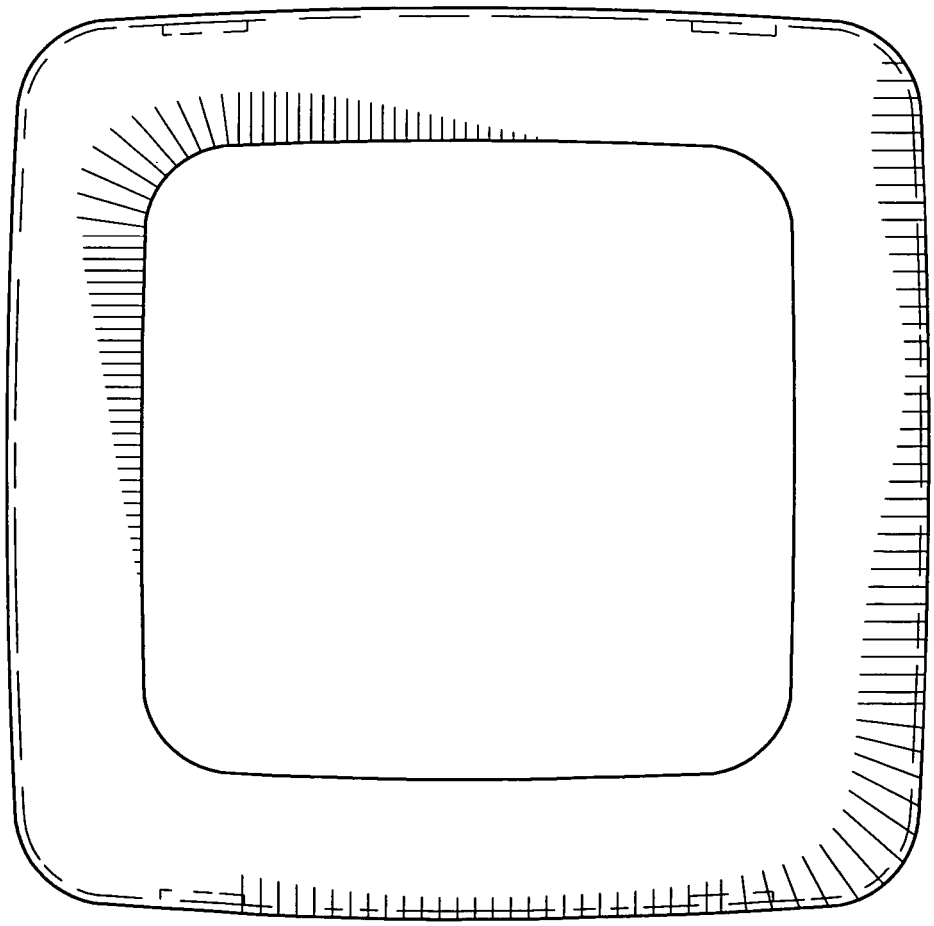
FIG. 6 is a front elevation view of FIG. 5.
Figure 11:
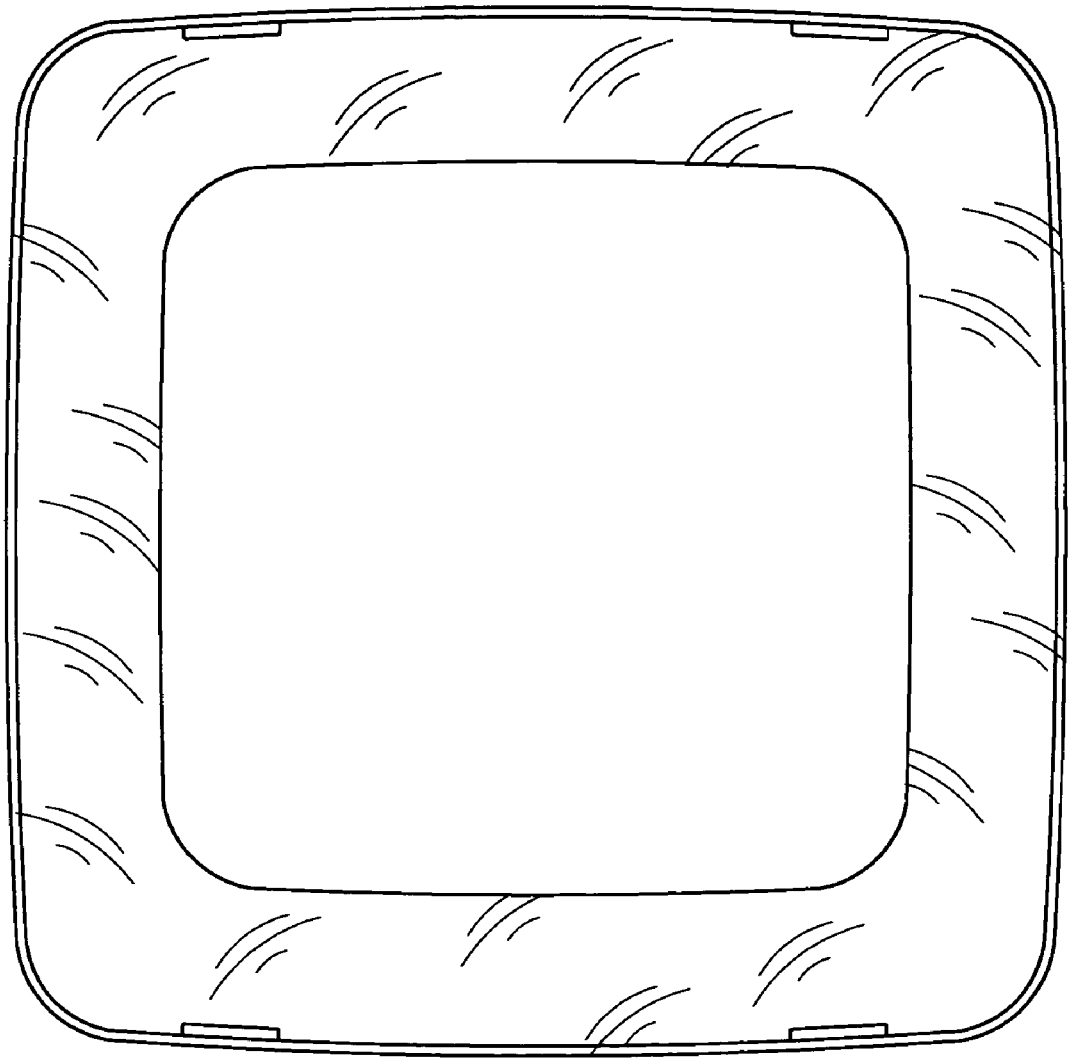
FIG. 11 is a rear elevation view of FIG. 5.
Figure 12:
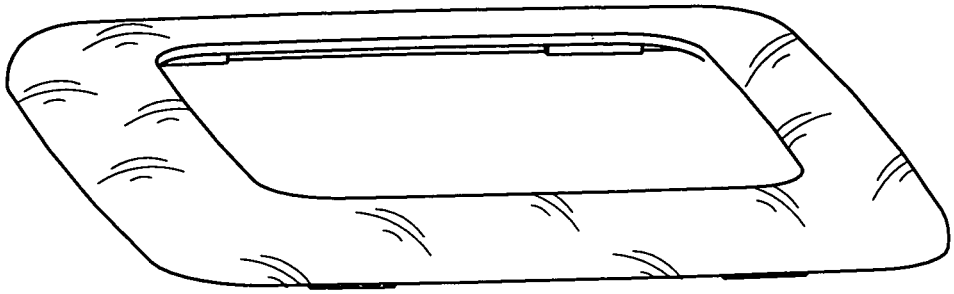
FIG. 12 is a perspective view of a decorative face plate of transparent or translucent material, according to the invention for a thermostatic controller.
Figure 13:
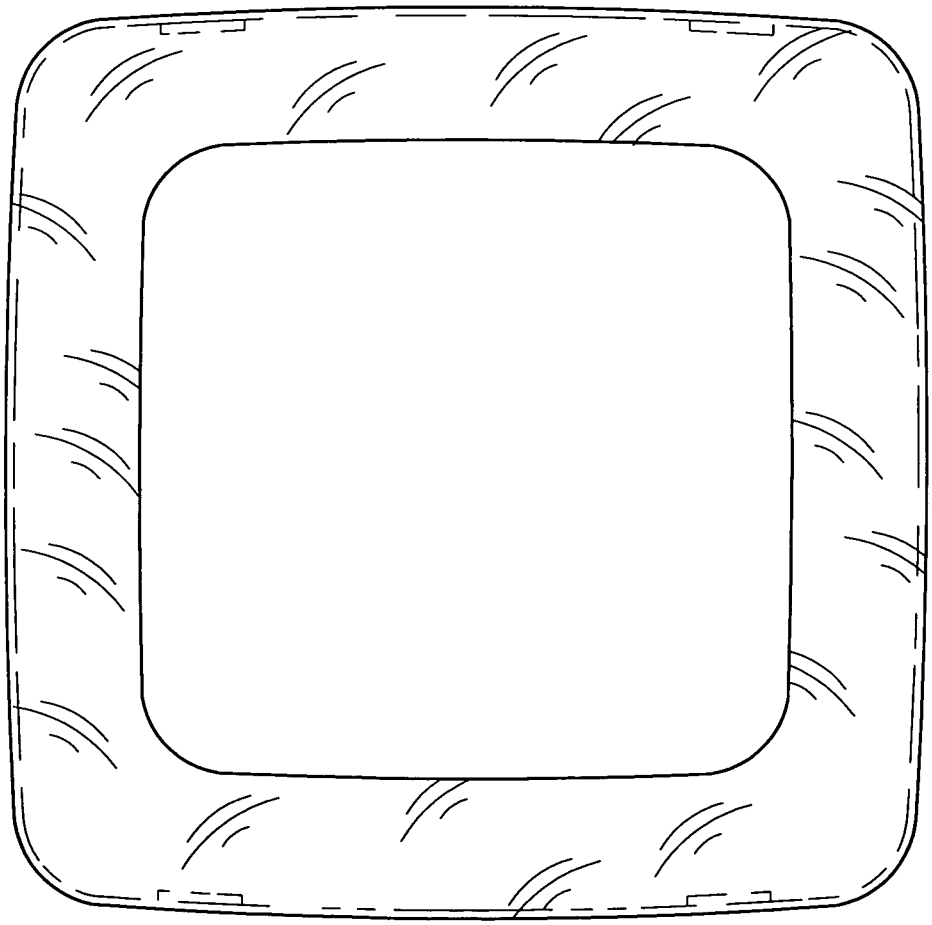
FIG. 13 is a front elevation view of FIG. 12.
Figure 18:
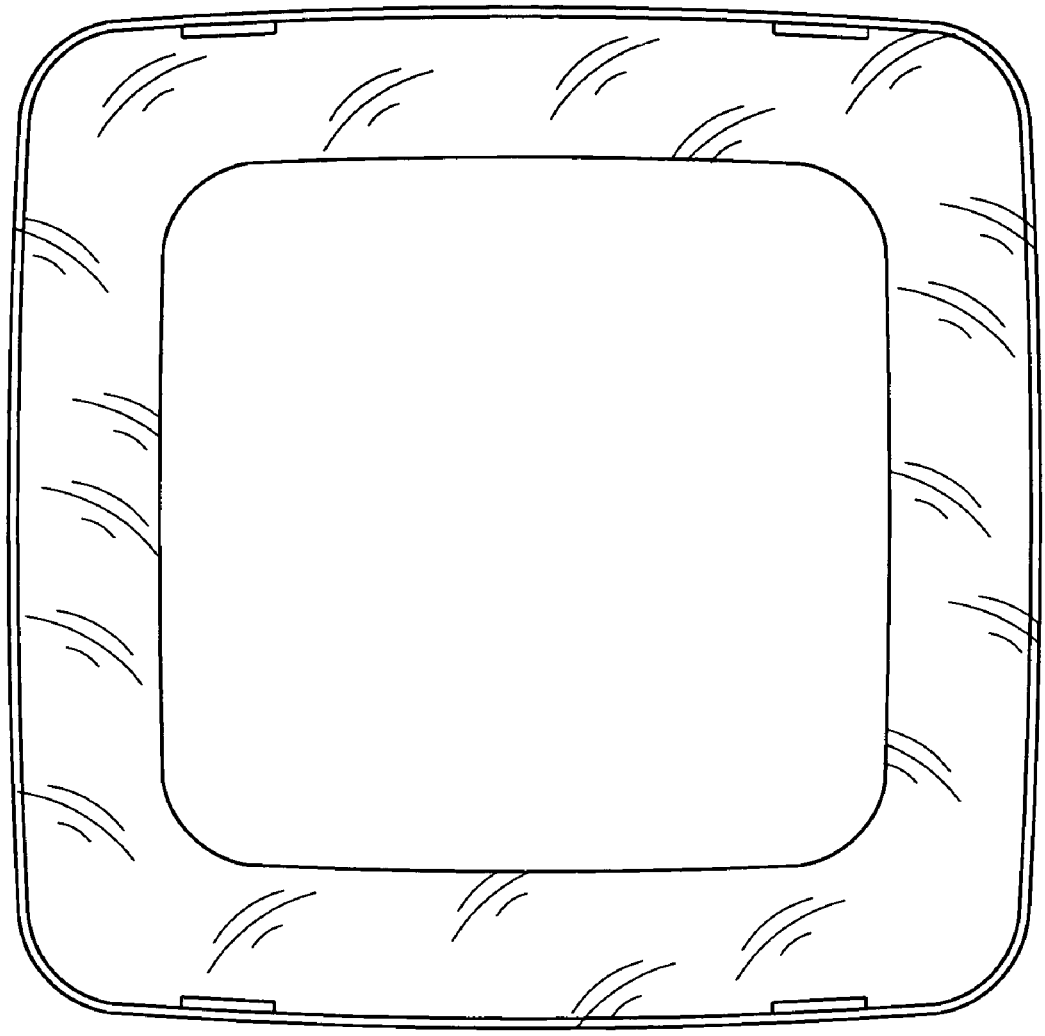
FIG. 18 is a rear elevation view of FIG. 12.
Figure 19:
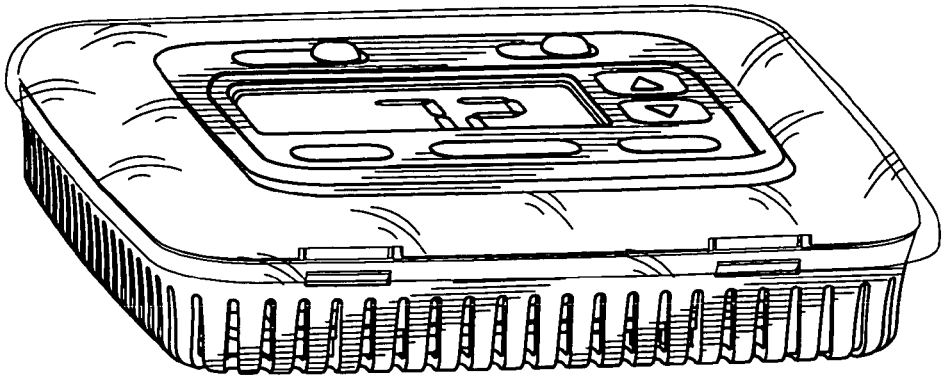
FIG. 19 is a perspective view of a thermostatic controller having a decorative face plate of transparent or translucent material attached to a housing of opaque material, according to the invention.
Figure 20:
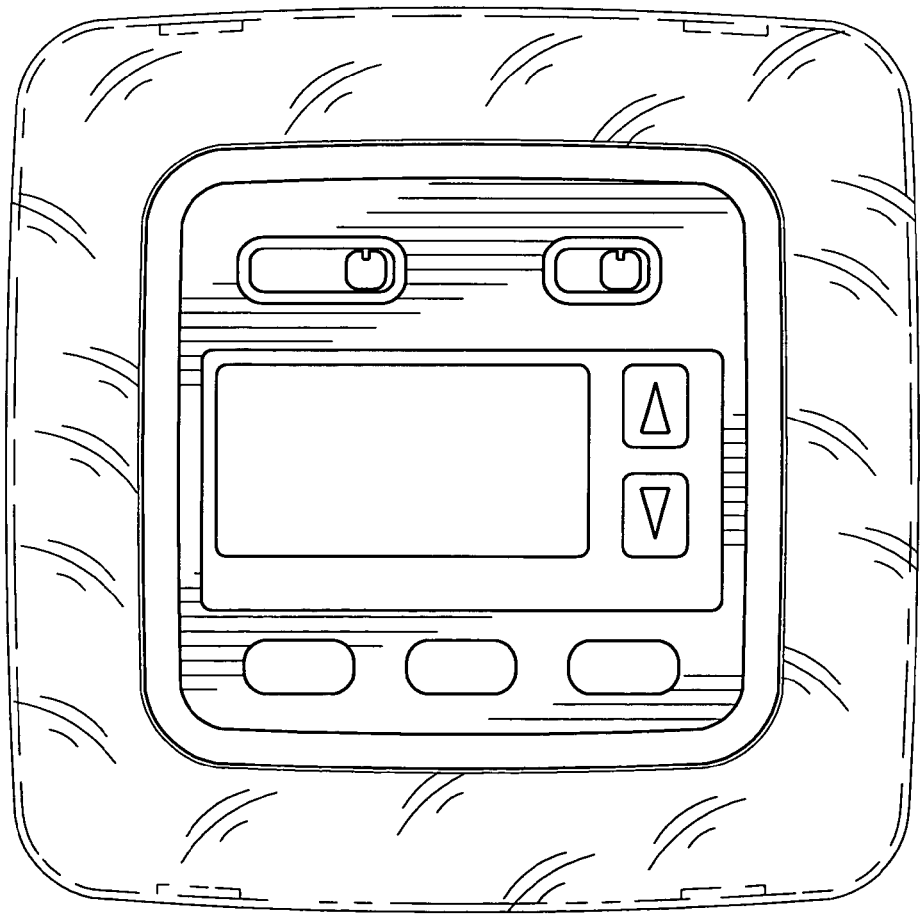
FIG. 20 is a front elevation view of FIG. 19.
Figure 25:
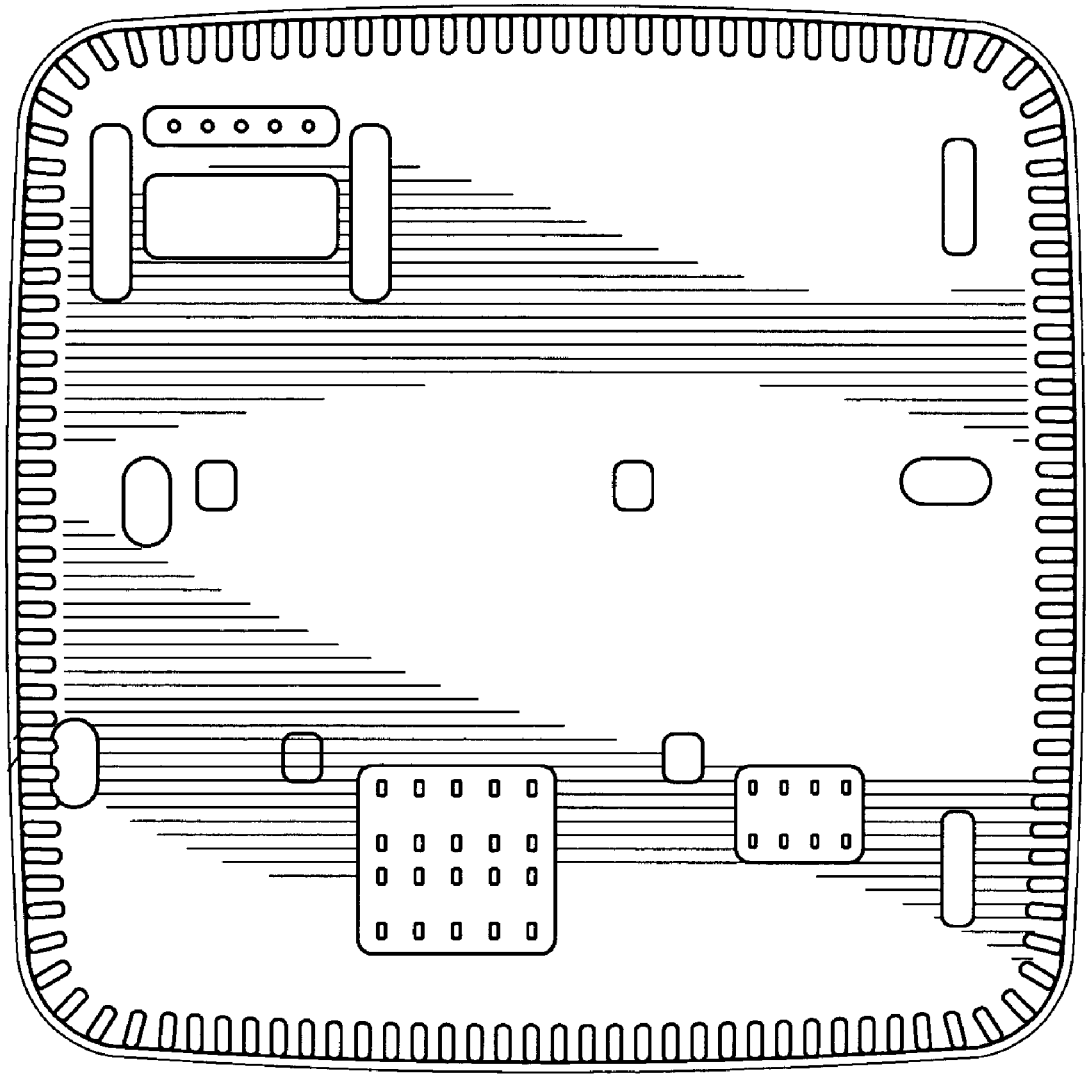
FIG. 25 is a rear elevation view of FIG. 19.
Figure 26:
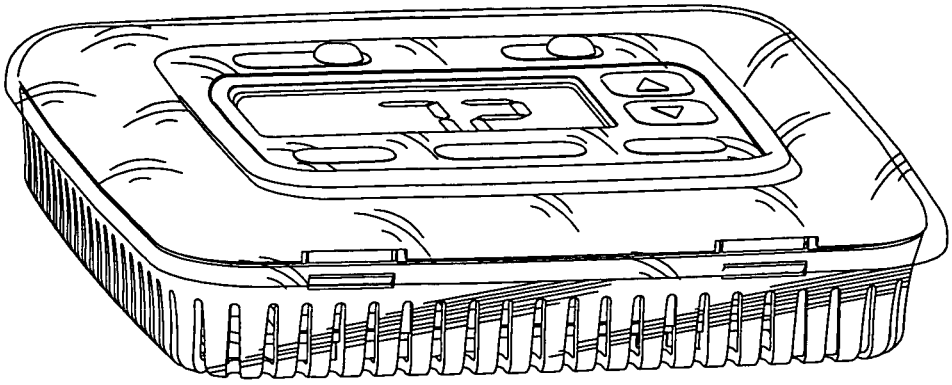
FIG. 26 is a perspective view of a thermostatic controller having a decorative face plate of transparent or translucent material attached to a housing of transparent or translucent material, according to the invention.
Figure 27:
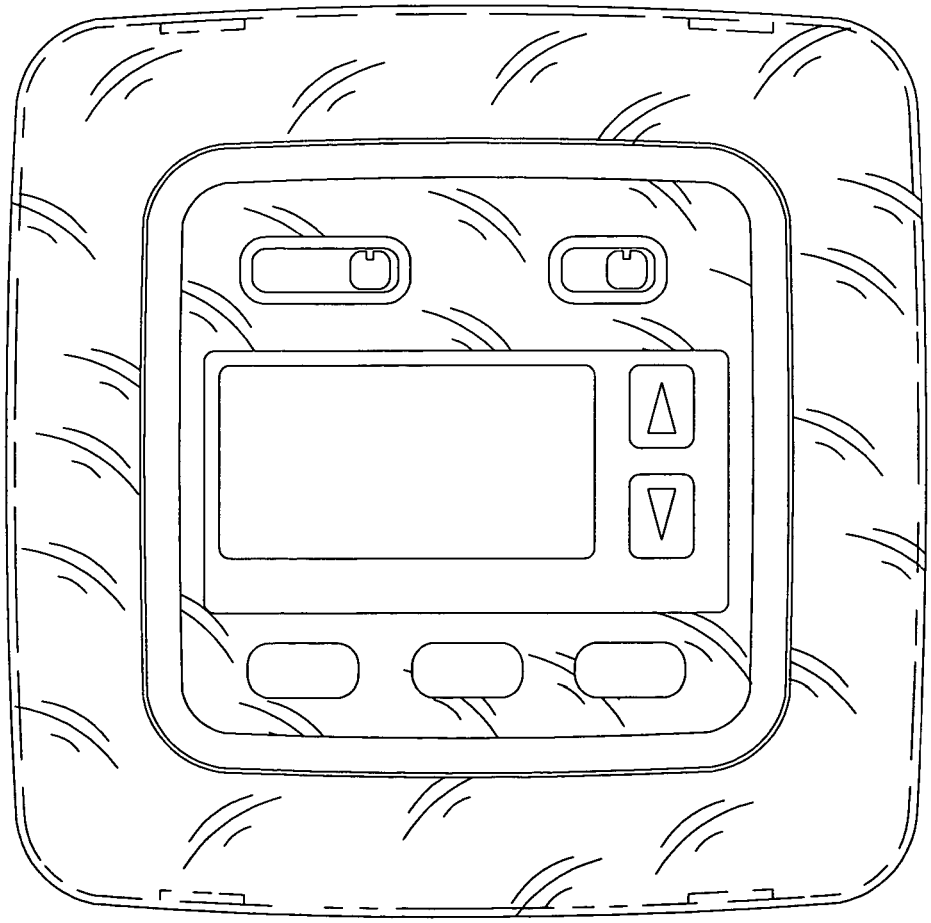
FIG. 27 is a front elevation view of FIG. 26.
Figure 32:
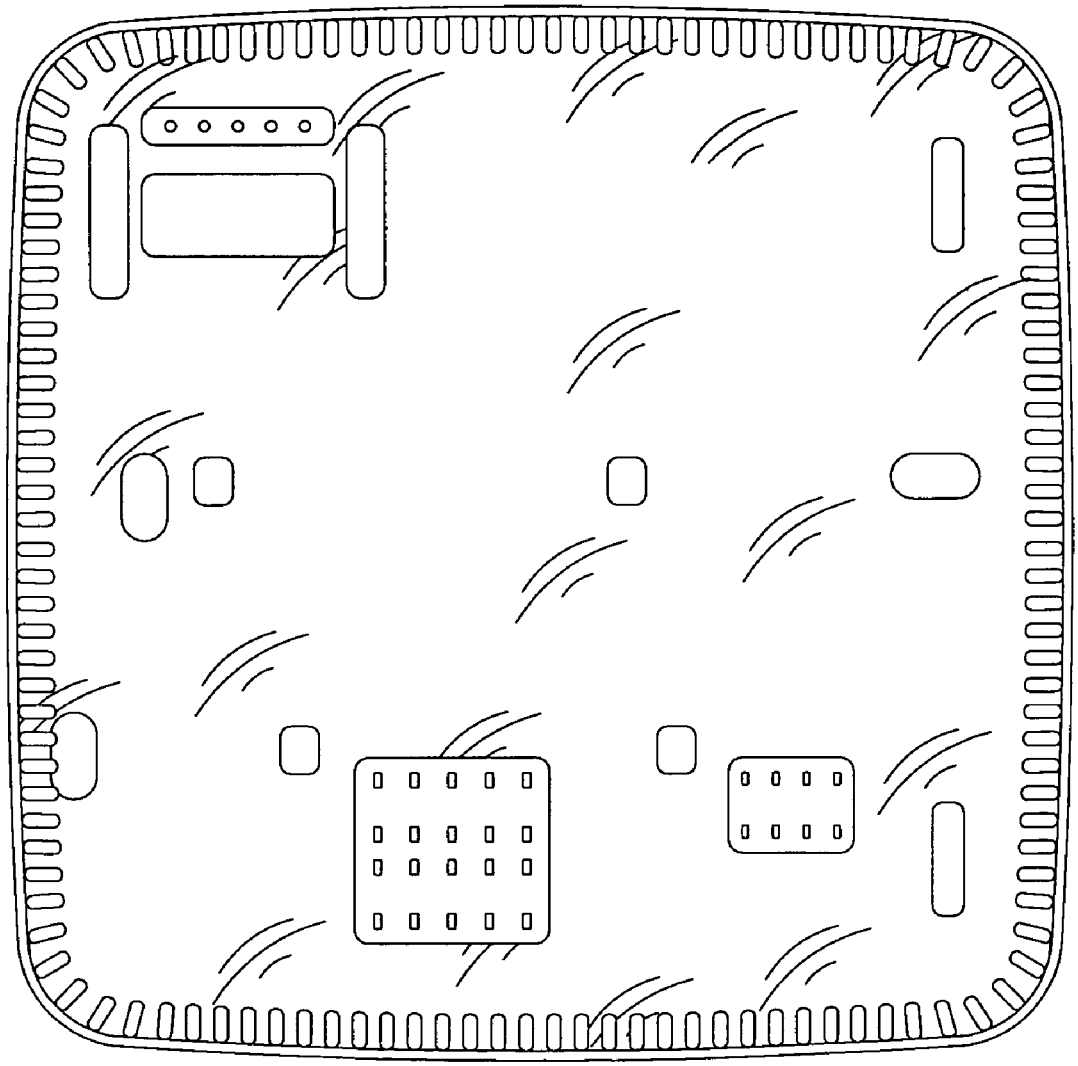
FIG. 32 is a rear elevation view of FIG. 26.
Figure 33:
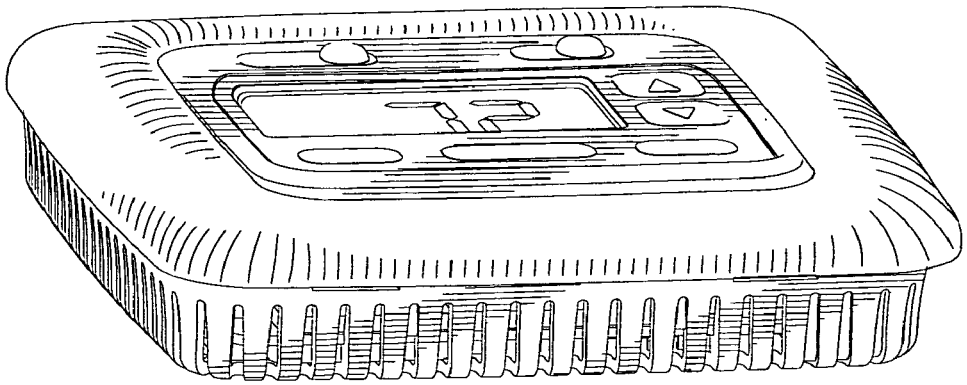
FIG. 33 is a perspective view of a thermostatic controller having a decorative face plate of opaque material attached to a housing of opaque material, according to the invention.
Figure 34:
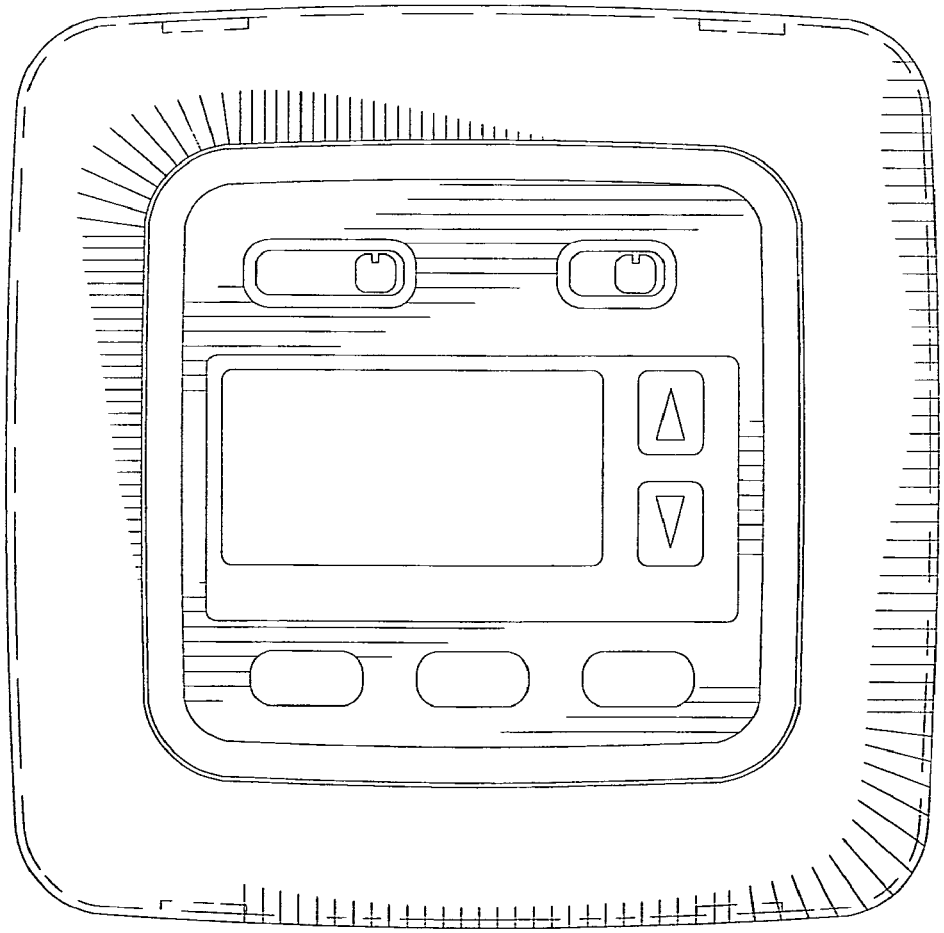
FIG. 34 is a front elevation view of FIG. 33.
Figure 39:
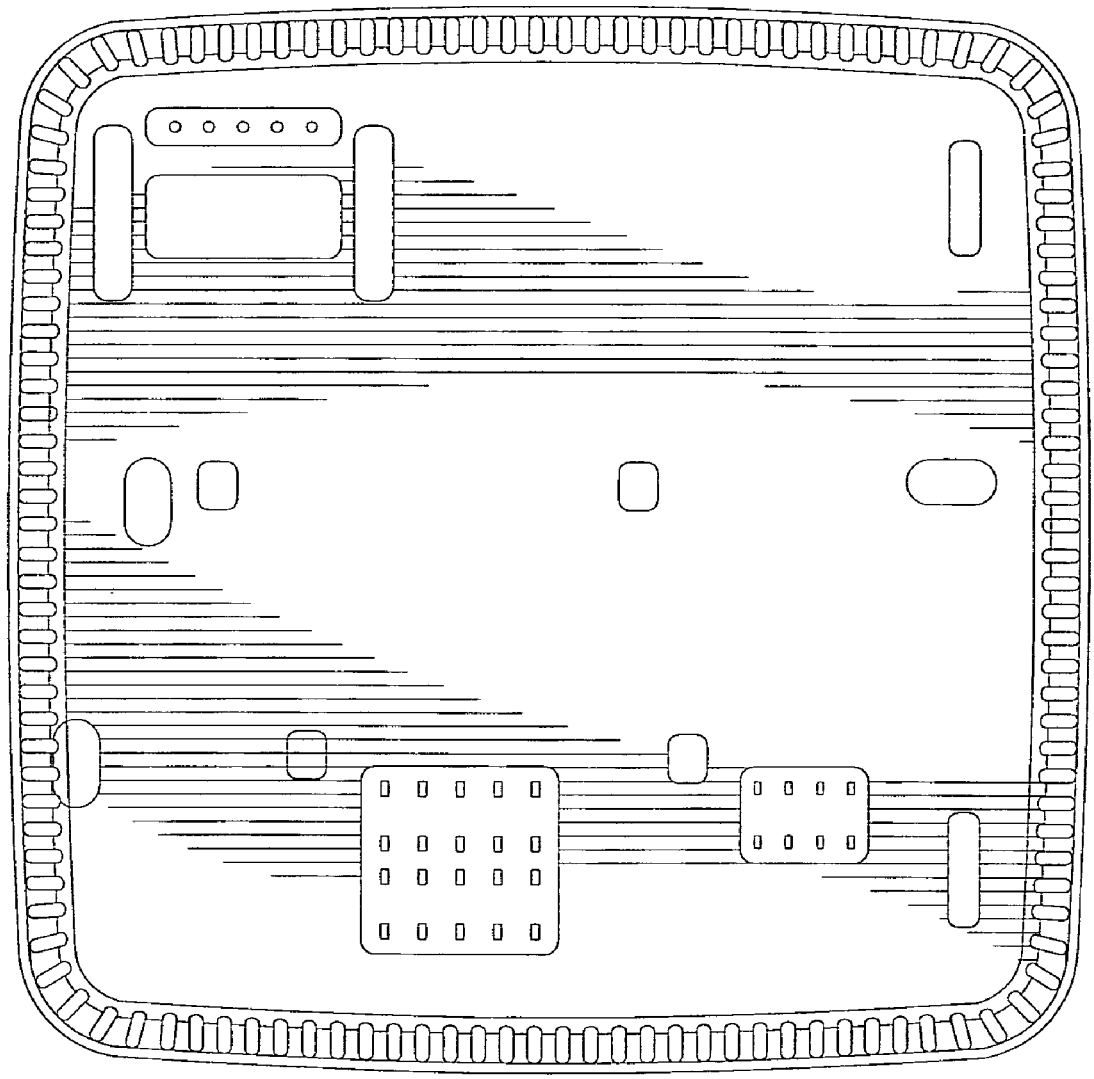
FIG. 39 is a rear elevation view of FIG. 33.
Figure 40:
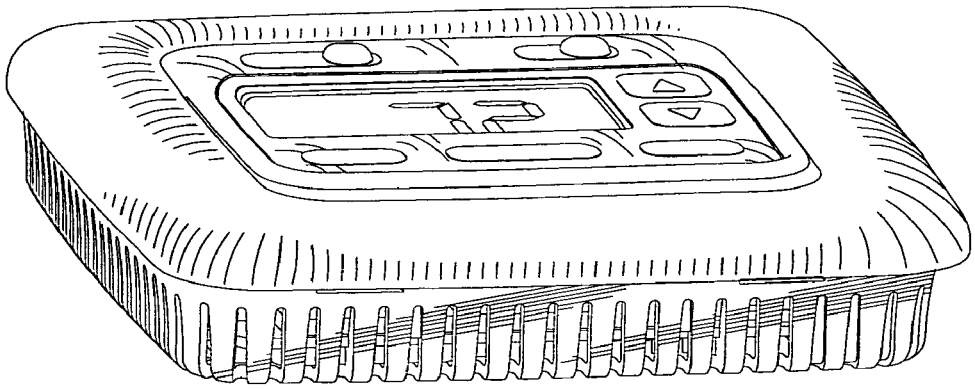
FIG. 40 is a perspective view of a thermostatic controller having a decorative face plate of opaque material attached to a housing of transparent or translucent material, according to the invention.
Figure 41:
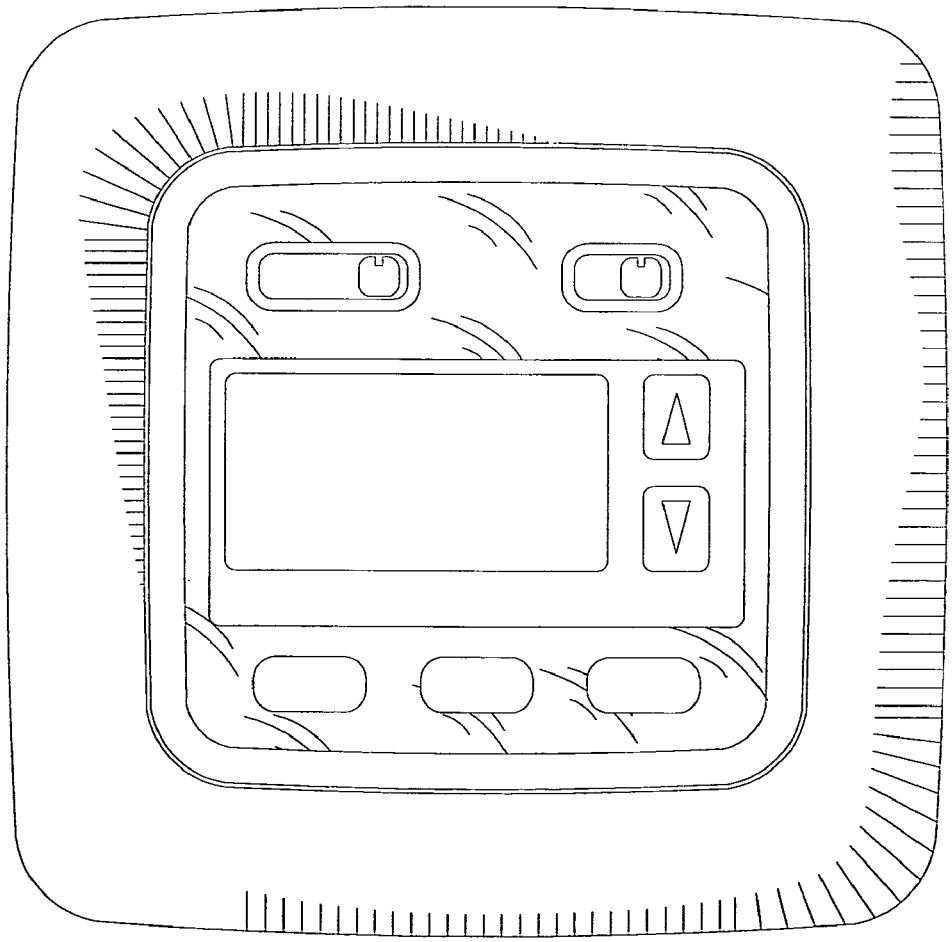
FIG. 41 is a front elevation view of FIG. 40.
Figure 46:
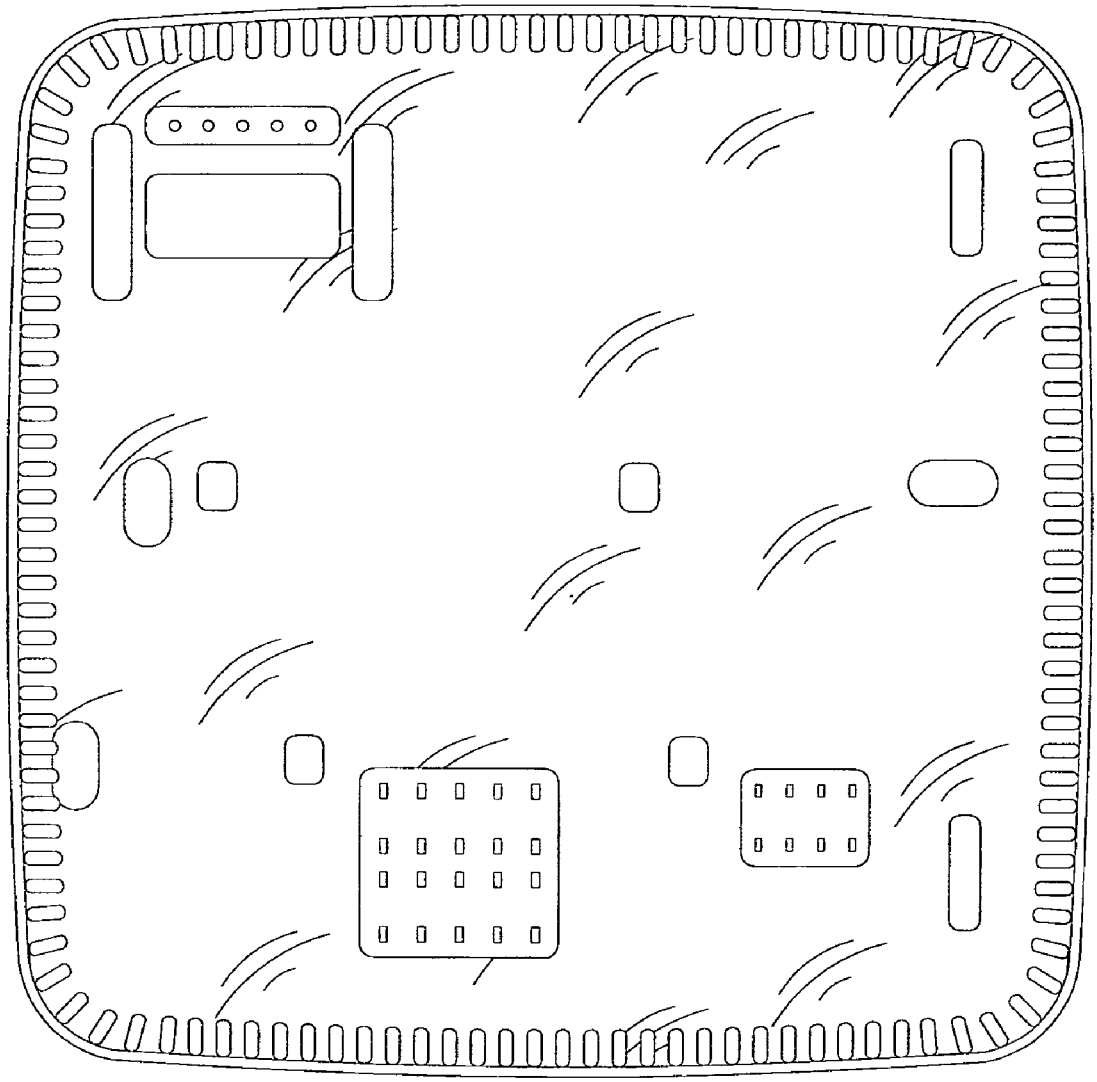
FIG. 46 is a rear elevation view of FIG. 40.
Figure 47:
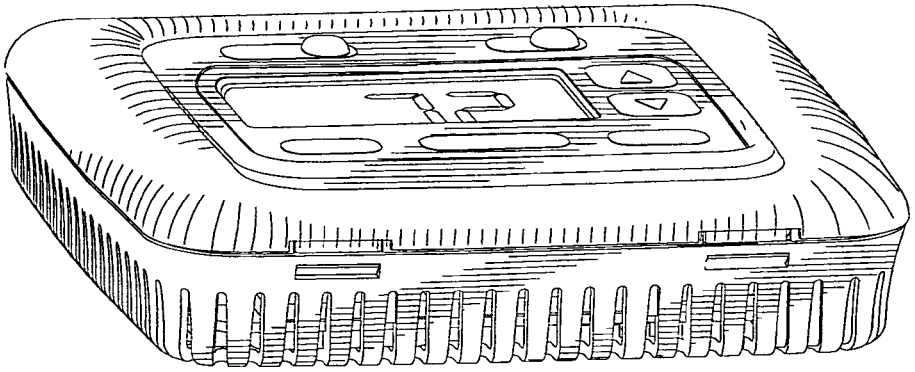
FIG. 47 is a perspective view of a thermostatic controller having a housing of opaque material, adapted for receiving but not including a decorative face plate, according to the invention.
Figure 48:
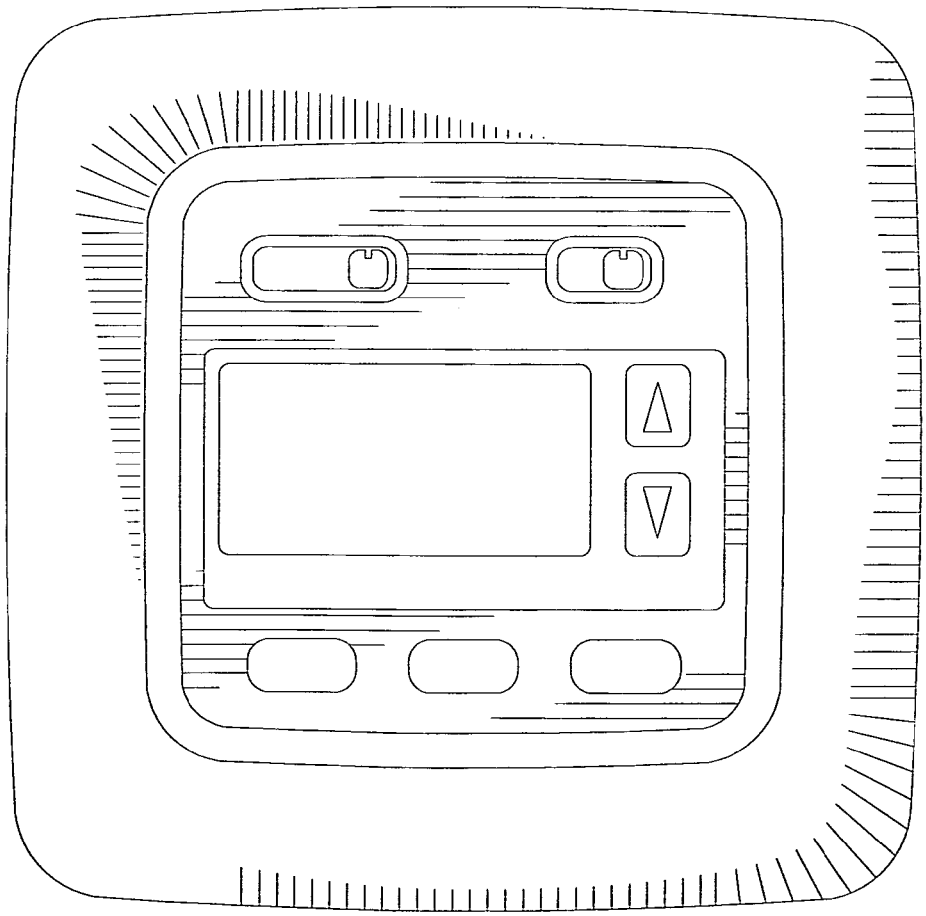
FIG. 48 is a front elevation view of FIG. 47.
Figure 53:
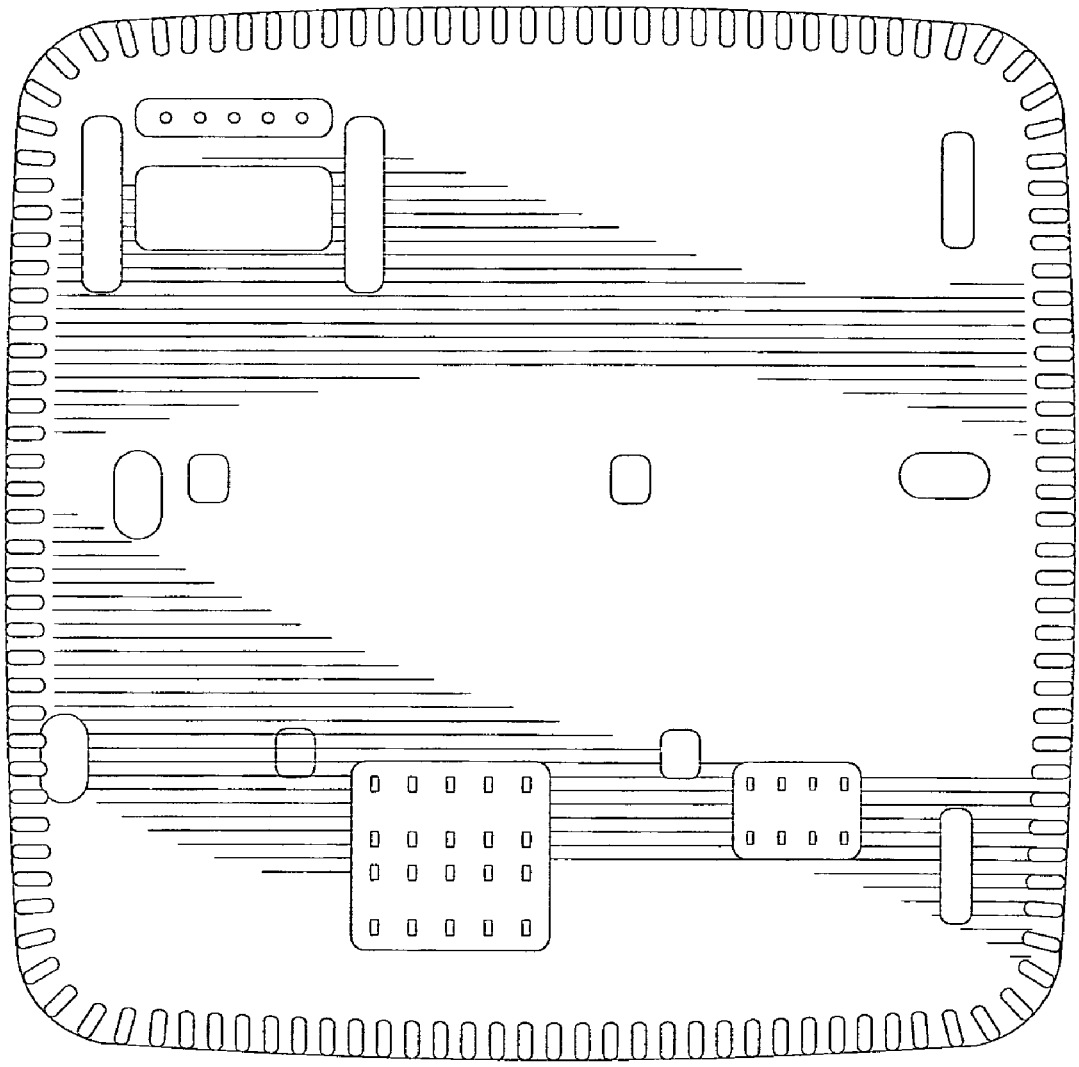
FIG. 53 is a rear elevation view of FIG. 47.
Figure 54:
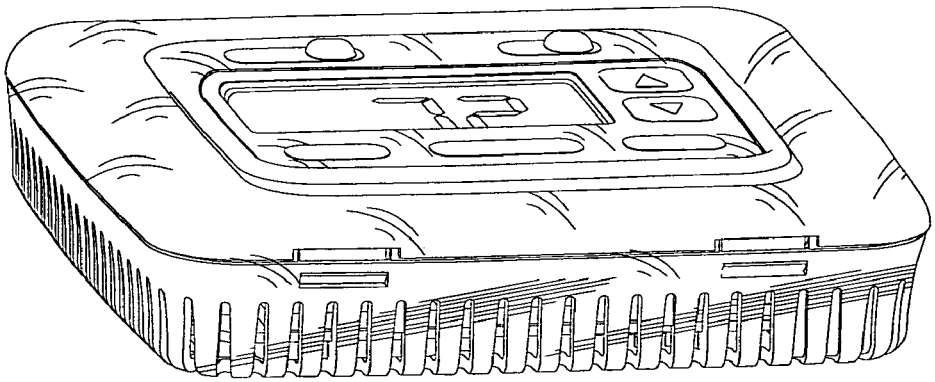
FIG. 54 is a perspective view of a thermostatic controller having a housing of transparent or translucent material, adapted for receiving but not including a decorative face plate, according to the invention.
Figure 55:
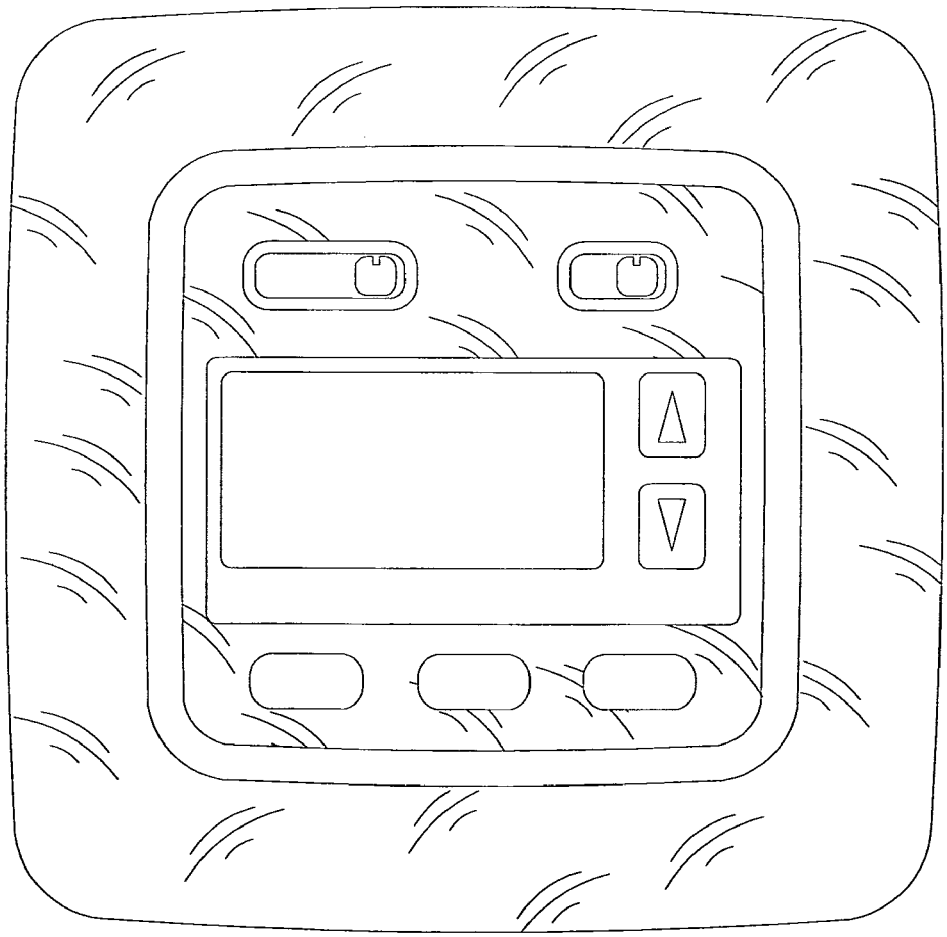
FIG. 55 is a front elevation view of FIG. 54.
Figure 60:
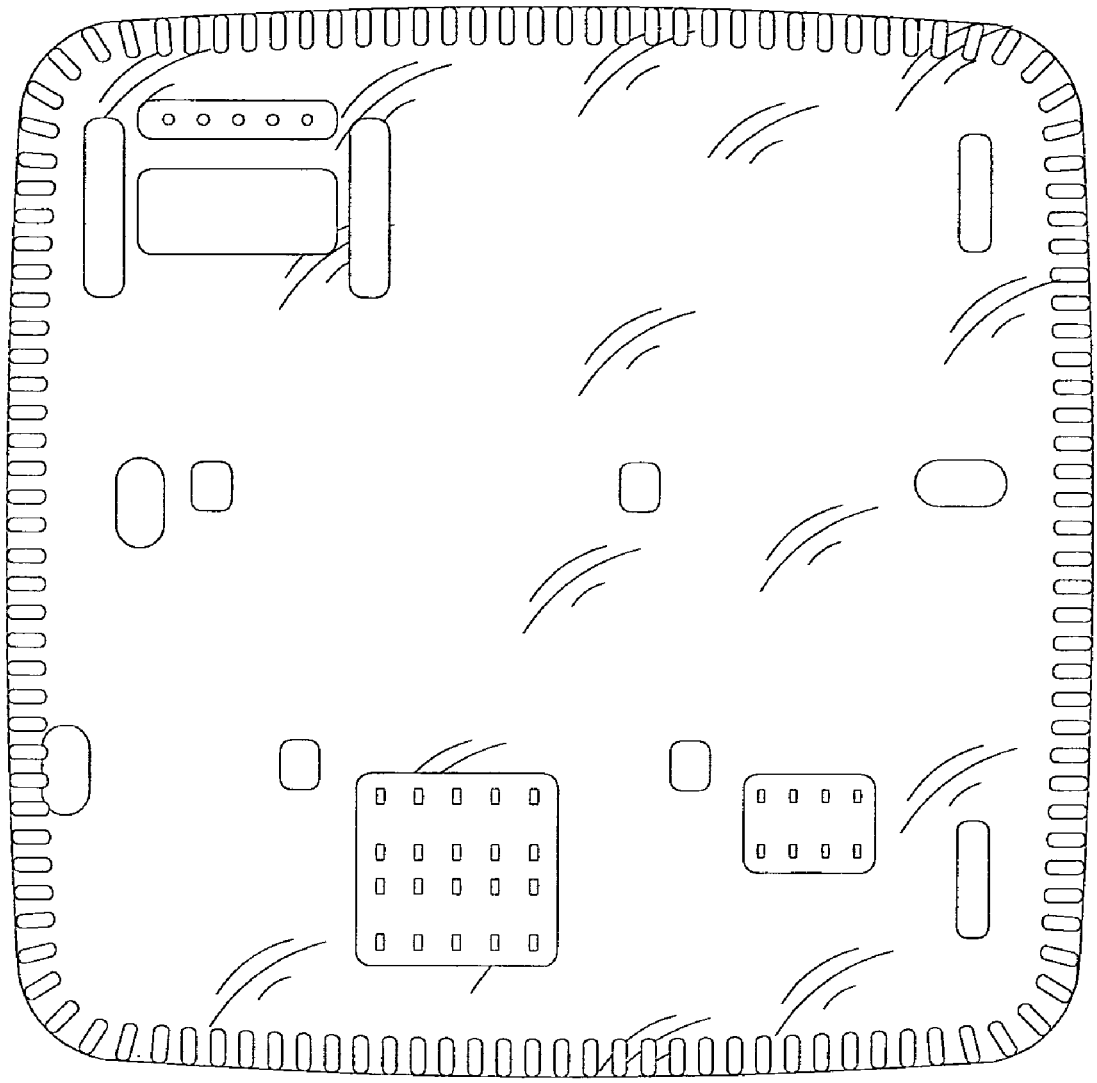
FIG. 60 is a rear elevation view of FIG. 54.

FIGS. 1-4 show an exemplary embodiment of a thermostatic controller apparatus 10, according to the invention. As shown in FIG. 2, the thermostatic controller apparatus 10 includes a housing 12 having a rear surface 14 adapted for attachment of the controller 10 to a wall surface. A front face 16 of the housing 12 defines a decorative surface 18 of the housing 12, which is adapted for optional attachment of a decorative face plate 20, as shown in FIGS. 3 and 4, for covering the decorative surface 18 of the housing 12.

As best seen in FIG. 1, the decorative surface 18 of the housing 12 defines an aperture 22 in the housing 12. The aperture 22 in the housing 12 allows a display 24, several pushbuttons 26, a keypad 28, and two slider switches 30 to be seen and accessed through the front face 16 of the housing 12. The front face 16 of the housing further defines a raised rim 32 extending around the aperture 22 in the housing 12. By virtue of this arrangement, the decorative surface 18 of the exemplary embodiment of the controller 10 forms a generally rectangular shaped frame around the raised rim 32, extending from the raised rim 32 to an outer periphery 34 of the housing 12.

The decorative face plate 20 of the exemplary embodiment of the controller 10 includes an aperture 36 which extends around the raised rim of the aperture 22 in the housing 12, when the decorative face plate 20 is attached to the housing 12.

The decorative face plate 20 of the exemplary embodiment of the controller 10 has a generally rectangular frame-shaped construction closely matching the shape of the decorative surface 18 of the housing 12, such that when the decorative face plate 20 is attached to the housing 12, it substantially covers the entire decorative surface 18 of the housing 12. In other embodiments of the invention, however, it may be desirable to have the decorative face plate 20 include holes, scrollwork, or other cutouts so that the decorative surface 18 of the housing is partially visible through the decorative face plate 20, when the decorative face plate 20 is attached to the housing 12. It may also be desirable, in other embodiments of the invention, to have the decorative face plate 20 be shaped in such a manner that it does not substantially cover the entire decorative surface of the housing 12.

The material selected for the housing 12 and the decorative face plate 20, and the appearance of the housing 12, the decorative surface 18 of the housing 12, and the appearance of the decorative face plate 20 can be varied in an almost infinite number of combinations to create a desired aesthetically pleasing look to the thermostatic controller apparatus 10. For example, the material or finish of the decorative face plate 20 may be selected in such a way that the decorative face plate 20 substantially obscures the decorative surface 18 from view when the decorative face plate 20 is attached to a housing 12. The decorative face plate 20, may also be fabricated from a transparent material, which may be clear or partially tinted, so that the decorative surface 19 of the housing 12 remains visible through the decorative face plate 20 when the face plate 20 is attached to the housing 12. It is also contemplated that the face plate 20 may be provided with either a front surface 38, and/or a rear surface 40, which can be decorated by painting or other methods to customize the appearance of the decorative face plate 20 to either match or contrast with the wall upon which the controller 10 is melted. Where the decorative face plate 20 is made from a transparent or translucent material, it is contemplated that it may be desirable to apply paint or other surface treatments to the rear surface 40 of the base plate 20 to achieve a glossy or matte appearance on the front surface 38 of the face plate 20.

It is also contemplated, for example, that in some embodiments of the invention it may be desirable to form the housing 12 from a transparent material, so that the interior components within the housing 12 are visible through the decorative surface 18 of the thermostat, when the thermostat 10 is used without a decorative face plate 20 attached.

It is contemplated that a decorative face plate 20, according to the invention, will typically have a visual appearance that is different than the visual appearance of the decorative surface 18 of the housing 12. The visual appearances of the decorative face plate 20 and the decorative surface 18 may vary from each other in a number of characteristics. For example, the decorative surface 18 of the housing 12 may be a different color or have a different surface texture than the decorative face plate 20. It is further contemplated that a thermostatic controller apparatus 10, according to the invention, may include two or more decorative face plates 20 having visual appearances that differ from one another, and also from the visual appearance of the decorative surface 18 of the housing 12. With such an arrangement, it may be desirable to provide a kit including several decorative face plates 20 with the controller 10. For example, such a kit might include decorative face plates in a chrome or brass metallic color, a black face plate, and one or more face plates of neutral earth tones or a white color. Additional face plates 20 might also be provided which are transparent, either clear or tinted, or face plates 20 having a front or rear surface adapted to be decorated so that the face plate might either match or contrast with the existing décor in the space in which the control is to be mounted. It is also contemplated that the controller 10 might be provided alone, without a decorative face plate 20, and that a variety of decorative face plates 20 having different colors and textures, etc., might be available for purchase and attachment to the housing 12 of the controller 10.

It is also contemplated that, at the time of purchasing the controller 10, a customer might be able to choose from several different models of the controller 10 having housings 12 including decorative surfaces 18 of a variety of visual appearances, colors, or textures.

In the exemplary embodiment of the controller 10, shown in FIGS. 1-4 and described herein, the decorative face plates 20 and the housing 12 respectively include mating features 42, 44 which allow the decorative face plate 20 to be attached to the housing 12, by snapping face plate 20 onto the housing 12. In other embodiments of the invention, however, other features and methods may also be used for attaching the decorative face plate 20 to the housing 12. The mating features 42, 44 of the exemplary embodiment provide the advantages of allowing the face plate 20 to be attached to the housing 12 without the use of tools, and also to be removed at a later date for changing the visual appearance of the controller 10 should it be desirable or necessary to do so at a later date.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A thermostatic controller apparatus, comprising:

a housing having a front face thereof defining a decorative surface of the housing and adapted for optional attachment of a decorative faceplate covering the decorative surface of the housing, the front face including at least one aperture therethrough;

a controller positioned within the housing, the controller configured to control at least one heating, ventilating or air conditioning (HVAC) appliance to control a temperature of an environment based on a predetermined temperature setting; and a user interface including at least a visual display positioned in one of the apertures of the housing.

2. The thermostatic controller apparatus of claim 1, further comprising a decorative faceplate adapted for optional attachment to the housing in such a manner that the decorative faceplate substantially covers the decorative surface of the housing.

3. The thermostatic controller apparatus of claim 2, wherein the decorative faceplate substantially obscures the decorative surface from view when attached to the housing without covering a side of the housing through which ambient air of the environment is allowed to flow.

4. The thermostatic controller apparatus of claim 2, wherein the decorative surface of the housing is transparent.

5. The thermostatic controller apparatus of claim 2, wherein the housing includes a raised rim around the at least one aperture, the decorative faceplate including an aperture configured to extend around the raised rim.

6. The thermostatic controller apparatus of claim 2, wherein the decorative faceplate has an outer surface defining at least one cutout positioned to allow at least a portion of the decorative surface of the housing to be seen therethrough.

7. The thermostatic controller apparatus of claim 2, wherein the decorative faceplate includes an aperture therein which aligns with all of the at least one aperture in the housing when the decorative faceplate is attached to the housing.

8. The thermostatic controller apparatus of claim 2, wherein the decorative surface of the housing has a visual appearance and the decorative faceplate has an outer surface of a different visual appearance than the visual appearance of the decorative surface of the housing.

9. The thermostatic controller apparatus of claim 2, further comprising two or more decorative faceplates having outer surfaces of differing visual appearances from one another.

10. The thermostatic controller apparatus of claim 9, wherein the decorative surface of the housing has a visual appearance and the decorative faceplates each have outer surfaces of a different visual appearance than the visual appearance of the decorative surface of the housing.

11. A method for changing the appearance of a thermostatic controller apparatus having a housing defining a front face thereof, the method comprising, configuring the front face of the housing of the thermostatic controller apparatus to form a decorative surface of the housing, and adapting the housing of the thermostatic controller apparatus for optional attachment of a decorative faceplate covering the decorative surface of the housing of the thermostatic controller apparatus without interfering with ambient air flow through the thermostatic controller housing.

12. The method of claim 11, further comprising, attaching a decorative faceplate to the housing of the thermostatic controller apparatus in such a manner that the decorative faceplate substantially covers the decorative surface of the housing of the thermostatic controller apparatus.

13. The method of claim 12, further comprising, removing the decorative faceplate.

14. The method of claim 12, wherein the decorative faceplate of claim 12 forms a first decorative faceplate having a first visual appearance, and the method further comprises:

removing the first decorative faceplate; and attaching a second decorative faceplate having a visual appearance different from the first decorative faceplate.

15. The method of claim 12, further comprising, removing the second decorative faceplate.

16. The method of claim 12, wherein the decorative faceplate is transparent, and has a rear surface thereof that can be decorated, and the method further comprises, decorating the rear surface of the decorative faceplate.

17. The method of claim 12, wherein the decorative faceplate has a front surface thereof that can be decorated, and the method further comprises, decorating the front surface of the decorative faceplate.

18. The method of claim 12, wherein the decorative surface of the housing defines at least one aperture in the housing, and the decorative faceplate includes an aperture corresponding to all of the at least one aperture in the housing therein, and the method further comprises aligning the aperture in the decorative faceplate with all of the at least one aperture in the decorative surface of the housing while attaching the decorative faceplate to the housing.

19. A thermostatic controller apparatus, comprising:

a housing having a front face thereof defining a decorative surface of the housing and adapted for optional attachment of a decorative faceplate covering the decorative surface of the housing, the front face of the housing including at least one aperture therethrough, the housing further having at least one air flow opening in at least one side surface thereof to communicate ambient air therethrough;

a controller positioned within the housing, the controller configured to control at least one heating, ventilating or air conditioning (HVAC) appliance to control a temperature of an environment based on a predetermined temperature setting;

a user interface including at least a visual display positioned in one of the apertures of the housing; and a plurality of decorative faceplates, each having a distinctive visual appearance and adapted for optional attachment to the housing in such a manner that at least one selected faceplate of the plurality of decorative faceplates substantially covers the decorative surface of the housing when the selected decorative faceplate is attached to the housing without interfering with ambient airflow through the housing.

20. The thermostatic controller apparatus of claim 19, wherein the decorative surface of the housing has a visual appearance and the selected decorative faceplates has a visual appearance that differs from the visual appearance of the decorative surface of the housing.

21. The thermostatic controller apparatus of claim 19, wherein the selected decorative faceplate includes an aperture therein which aligns with all of the at least one aperture in the front face of the housing when the decorative faceplate is attached to the housing.

22. A thermostatic controller apparatus comprising a decorative faceplate adapted for optional attachment to, but not including, a housing of a thermostatic controller having a front face thereof defining a decorative surface of the housing and adapted for optional attachment of a decorative faceplate covering the decorative surface of the housing, the decorative faceplate being configured for substantially covering the decorative surface of the housing when the decorative faceplate is optionally attached to the housing without interfering with ambient airflow though the housing of the thermostatic controller.

23. The thermostatic controller apparatus of claim 22, wherein the decorative faceplate substantially obscures the decorative surface from view when attached to the housing.

24. The thermostatic controller apparatus of claim 22, wherein the decorative faceplate is transparent, and has a rear surface thereof that can be decorated.

25. The thermostatic controller apparatus of claim 22, wherein the decorative faceplate has an outer surface that can be decorated.

26. The thermostatic controller apparatus of claim 22, wherein the decorative surface of the housing defines an aperture in the housing, and the decorative faceplate includes an aperture therein which aligns with the aperture in the housing when the decorative faceplate is attached to the housing.

27. The thermostatic controller apparatus of claim 22, wherein the decorative surface of the housing has a visual appearance and the decorative faceplate has an outer surface of a different visual appearance than the visual appearance of the decorative surface of the housing.

28. The thermostatic controller apparatus of claim 22, further comprising two or more decorative faceplates having outer surfaces of differing visual appearances from one another.

29. The thermostatic controller apparatus of claim 28, wherein the decorative surface of the housing has a visual appearance and the decorative faceplates each have outer surfaces of a different visual appearance than the visual appearance of the decorative surface of the housing.

* * * * *